US007503696B2

(12) United States Patent
Ha et al.

(10) Patent No.: US 7,503,696 B2
(45) Date of Patent: Mar. 17, 2009

(54) PACK SEALING METHOD AND DEVICE

(75) Inventors: Jae-Ho Ha, Daegu (KR); Seung-Taek Lee, Daegu (KR)

(73) Assignee: Sehyang Industrial Co., Ltd., Daegu (KR)

( * ) Notice: Subject to any disclaimer, the term of this patent is extended or adjusted under 35 U.S.C. 154(b) by 702 days.

(21) Appl. No.: 10/532,714

(22) PCT Filed: Nov. 5, 2003

(86) PCT No.: PCT/KR03/02361

§ 371 (c)(1),
(2), (4) Date: Apr. 27, 2005

(87) PCT Pub. No.: WO2004/043810

PCT Pub. Date: May 27, 2004

(65) Prior Publication Data

US 2006/0053753 A1 Mar. 16, 2006

(30) Foreign Application Priority Data

Nov. 13, 2002 (KR) ..... 10-2002-0070473
Apr. 29, 2003 (KR) ..... 10-2003-0027221

(51) Int. Cl.
*B65D 33/16* (2006.01)
*A41F 1/00* (2006.01)

(52) U.S. Cl. ..... 383/69; 383/61.2; 383/63; 383/89; 24/30.5 R; 24/455

(58) Field of Classification Search ..... 383/69, 383/63, 61.2, 89, 90, 82, 83, 88; 24/30.5 R, 24/537, 455
See application file for complete search history.

(56) References Cited

U.S. PATENT DOCUMENTS

| | | | | | |
|---|---|---|---|---|---|
| 468,257 | A | * | 2/1892 | Paige | 383/13 |
| 473,337 | A | * | 4/1892 | Paige | 383/22 |
| 1,361,605 | A | * | 12/1920 | Morrill | 383/69 |
| 3,141,221 | A | * | 7/1964 | Faulls, Jr. | 24/30.5 R |
| 3,346,883 | A | * | 10/1967 | Ersek | 4/661 |
| 3,933,158 | A | * | 1/1976 | Haverstock | 606/216 |
| 4,541,117 | A | * | 9/1985 | Ashbeck | 383/64 |
| 5,354,132 | A | * | 10/1994 | Young et al. | 383/49 |
| 5,765,264 | A | * | 6/1998 | Ciok | 24/30.5 R |

FOREIGN PATENT DOCUMENTS

| | | | |
|---|---|---|---|
| JP | 61-62840 | U | 4/1986 |
| JP | 03-216127 | A | 9/1991 |

* cited by examiner

*Primary Examiner*—Jes F Pascua
(74) *Attorney, Agent, or Firm*—Birch, Stewart, Kolasch & Birch, LLP

(57) ABSTRACT

A pack sealing method and device in which a slit tubular member (16) is slidably fitted around a wrapped portion of a pack (8) (a bag or envelope made of a diverse material while having a diverse size and a diverse shape) formed as a portion of the pack (8) near an opening (4) of the pack (8) is wrapped around a rod member (14), in a state in which a diverse liquid, gaseous, and solid material or object is put into the pack (8) through the opening (4). The rod member (14') is fixedly bonded to the inner or outer surface of the pack (8) or separate from the pack (8). Where the pack (8) is a zipper pack provided with a zipper, this zipper functions as the rod member.

10 Claims, 36 Drawing Sheets

PACK SEALING METHOD AND DEVICE

TECHNICAL FIELD

The present invention relates to a pack sealing method and device for sealing the opening of a pack adapted to contain diverse liquid, gaseous, and solid materials or objects, in a state in which such a material or object is put into the pack through the opening.

BACKGROUND ART

Generally, where food and drink, in particular, food, is stored or packed in a sealed or vacuum state so that it cannot come into contact with air or oxygen, it is possible to prevent the food from being oxidized or rotting, to considerably lengthen the storage period of the food, and to maintain the freshness and intrinsic smell of the food for a prolonged period of time.

For such a purpose, a zipper pack has been proposed in which a zipper consisting of female and male zipper members is provided at an opening of the pack, so as to conveniently seal the opening. However, this zipper pack has a problem in that the seal may be easily collapsed by external pressure. Also, there are problems of a difficulty in manufacture and an increase in manufacturing cost.

Also, a hinged sealing device has been proposed which has two members hingably connected to each other, and adapted to clamp the opening portion of a pack therebetween. However, this hinged sealing device cannot provide a reliable seal. Furthermore, it is inconvenient to use this sealing device. In particular, there is a problem caused by the structure of the sealing device in that the seal at the middle portion of the sealing device is weak.

Meanwhile, general vinyl packs made of a polyethylene (PE) film or polypropylene (PP) film can be inexpensively and easily manufactured. However, such a vinyl pack does not have a dense structure, so that smell molecules of the contents in the vinyl pack may pass through the vinyl pack, thereby emitting foul odors.

When the opening of such a vinyl pack is widened to put a material into the vinyl pack, it may not be maintained in the widened state. For this reason, where a soup containing solids is to be put into the vinyl pack, there is a problem in that the liquid or solids of the soup may be smeared on the outer surface of the vinyl pack around the opening or flow along the outer surface of the vinyl pack, thereby staining the vinyl pack. Such a problem is mainly caused by the fact that both the general vinyl pack and the vacuum vinyl pack have an insufficient rigidity to maintain the opened state of their openings, or they have no means for maintaining the opened state of their openings.

DISCLOSURE OF THE INVENTION

An object of the invention is to provide a pack sealing method and device in which a pack sealing means is slidably fitted around a folded or wrapped portion of a pack (a bag or envelope made of a diverse material while having a diverse size and a diverse shape) formed as the opening of the pack is folded or wrapped in a state in which a diverse liquid, gaseous, and solid material or object is put into the pack through the opening, so that a desired seal for the pack is conveniently and reliably achieved.

In accordance with the present invention, a rod member included in a pack sealing device is formed at or bonded to the inner or outer surface of a pack, to be sealed, near an opening of the pack or at a middle portion of the pack. A desired portion of the pack is wrapped around the rod member. In this state, a slit tubular member included in the pack sealing device is slidably fitted around the rod member wrapped by the pack portion. Thus, the pack is reliably sealed by the pack sealing device.

In accordance with the present invention, at least one ring may be formed at the outer surface of the tubular member to connect a string such as a necklace to the pack sealing device. In this case, the user may wear the pack containing desired contents on the neck via the string to carry the pack or hang the pack on a wall to store the pack.

In accordance with the present invention, the rod member of the pack sealing device may be formed, at one end thereof, with a bent portion, so as to more easily achieve the coupling of the pack to the pack sealing device. A protruded stopper may also be formed at the one end of the rod member, so as to prevent the sealed pack from being separated from the pack sealing device by an external force. In addition, a semicircular protrusion may be formed at the tip of the rod member, so as to guide the pack to be easily slidably fitted in the pack sealing device.

Where the rod member is attached to the pack while being made of a hard material, a plurality of grooves are formed at the outer surface of the rod member such that they are spaced apart from one another by a small distance in accordance with the present invention, so as to allow the rod member to be flexible. On the other hand, where the pack to be sealed by the pack sealing device is a zipper pack, the tubular member is slidably fitted around the zipper wrapped by a portion of the zipper pack, so as to seal the zipper pack. A plurality of grooves may be formed at the outer surface of the tubular member such that they are spaced apart from one another by a small distance, so as to allow the tubular member to be flexible.

In the pack sealing device according to the present invention, the slit tubular member is slidably fitted around the rod member wrapped by a portion of the pack. A slit is formed at the tubular member to extend in a longitudinal direction of the tubular member. A squeeze gap is defined between the rod member and the tubular member in order to fit a portion of the pack, to be sealed, in a squeezed fashion. In accordance with the cooperation of the rod member and tubular member, the pack inserted into the squeeze gap is sealed in a squeezed state. Since most of the facing surfaces of the rod member and tubular member serve to squeeze the pack, a firm squeeze is achieved, thereby providing a reliable seal for the pack.

BEST MODE FOR CARRYING OUT THE INVENTION

Figure 1:
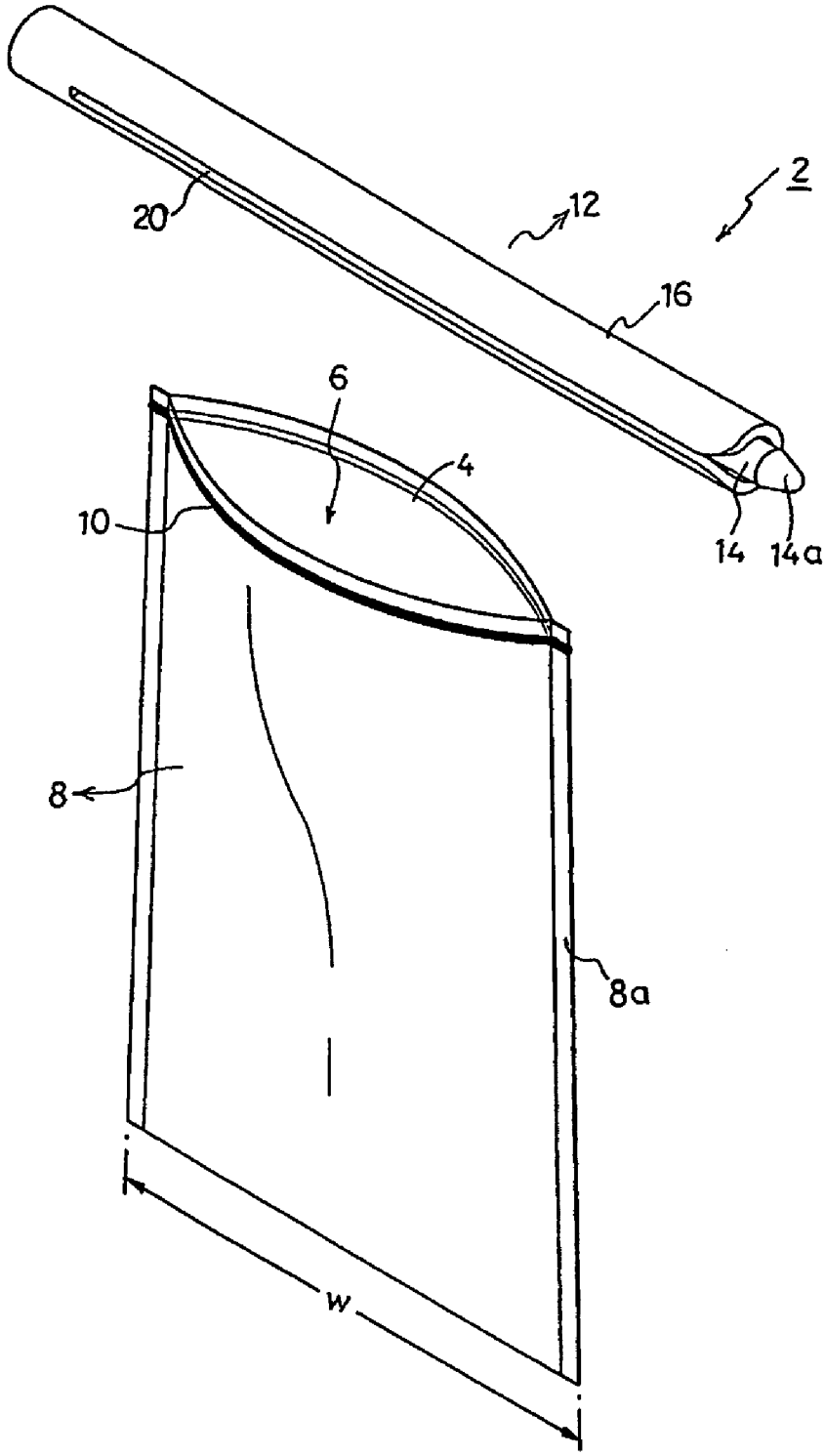
FIG. 1 is a perspective view illustrating a pack and a pack sealing device according to an embodiment of the present invention.

In the annexed drawings, the same or similar elements are designated by the same reference numerals even though they are depicted in different drawings. In the following description of the present invention, a detailed description of known functions and configurations incorporated herein will be omitted when it may make the subject matter of the present invention rather unclear. Now, preferred embodiments of the present invention will be described in detail with reference to the annexed drawings.

Although diverse liquid, gaseous, and solid materials may be packed in a sealed or vacuum state in accordance with the present invention, the following description will be described in conjunction with food commonly encountered in the course of daily life, for convenience of description.

Referring to FIG. 1, a pack sealing device 2 according to the present invention is illustrated which is adapted to seal a pack 8. The pack sealing device 2 includes a rod member 14, a tubular member 16 adapted to be slidably fitted around the rod member 14, a squeeze gap 18 defined between the rod member 14 and the tubular member 16 to squeeze a desired portion of the pack 8 in a state in which the tubular member 16 is fitted around the rod member 14, and a slit 20 formed at the tubular member 16 to extend in a longitudinal direction of the tubular member 16.

The rod member 14 has an outer diameter different from the inner diameter of the tubular member 16 so that the squeeze gap 18 is defined therearound. That is, the outer diameter of the rod member 14 is smaller than the inner diameter of the tubular member 16.

The tubular member 16 is open at one end (a front end) or both ends (front and rear ends) thereof so that it can be slidably fitted around the rod member 14. In accordance with such a structure of the tubular member 16, each of the squeeze gap 18 and slit 20 is open at one end thereof, so that it receives a desired portion of the pack 8 through one open end thereof, thereby allowing the pack portion to be slidably fitted between the rod member 14 and the tubular member 16. In order to achieve easy insertion of a desired portion of the pack 8 into the pack sealing device 2, each of the rod member 14 and tubular member 16 is formed with an inclined surface or inclined guide at one end thereof. Similarly, each of the squeeze gap 18 and slit 20 has an inclined surface or inclined guide at one end thereof.

The rod member 14 may have a diverse cross-sectional shape. For example, the rod member 14 may have a circular, semicircular, oval, semi-oval, triangular, or rectangular cross-sectional shape. In addition, the rod member 14 may have a polygonal cross-sectional shape such as a diamond, trapezoidal, pentagonal, hexagonal, or octagonal cross-sectional shape, or a modified cross-sectional shape therefrom. That is, the rod member 14 may have an optional cross-sectional shape in so far as it is possible to achieve an easy squeezing of the pack 8 while securing a reliable sealing effect.

Figure 2:
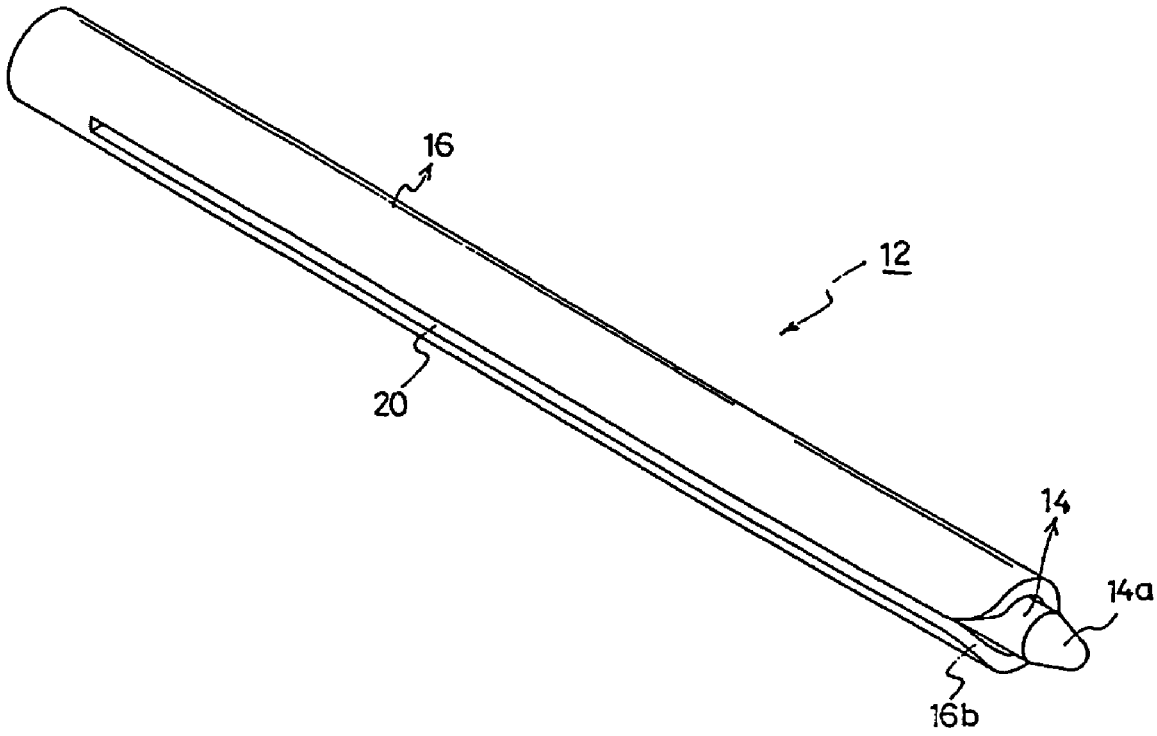
FIG. 2 is a perspective view illustrating the appearance of the pack sealing device according to the embodiment of the present invention.

In the pack sealing device 1 according to the embodiment of the present invention illustrated in FIGS. 1 and 2, the tubular member 14 is open at one end thereof so as to allow the opening portion of the pack 8 to be inserted therein, while being closed at the other end thereof by means of a thermal fusing or bonding method or a male/female fitting method. In accordance with such a structure of the tubular member 16, each of the squeeze gap 18 and slit 20 is open at one end thereof while being closed at the other end thereof.

When it is desired to seal the pack 8, the opening portion of the pack 8 is first wrapped around one end of the rod member 14, and then inserted into the squeeze gap 18 while passing through the slit 20. Thus, the opening portion of the pack 8 is squeezed in the squeeze gap 18 in accordance with the cooperation of the rod member 14 and tubular member 16, so that it is maintained in a sealed state, as shown in FIGS. 11 to 14.

That is, the opening portion of the pack 8 including the opening 4 is in contact with the rod member 14 and tubular member 16 at a wide area while being squeezed between the rod member 14 and the tubular member 16, so that it is maintained in a tightly sealed state.

Figure 3:
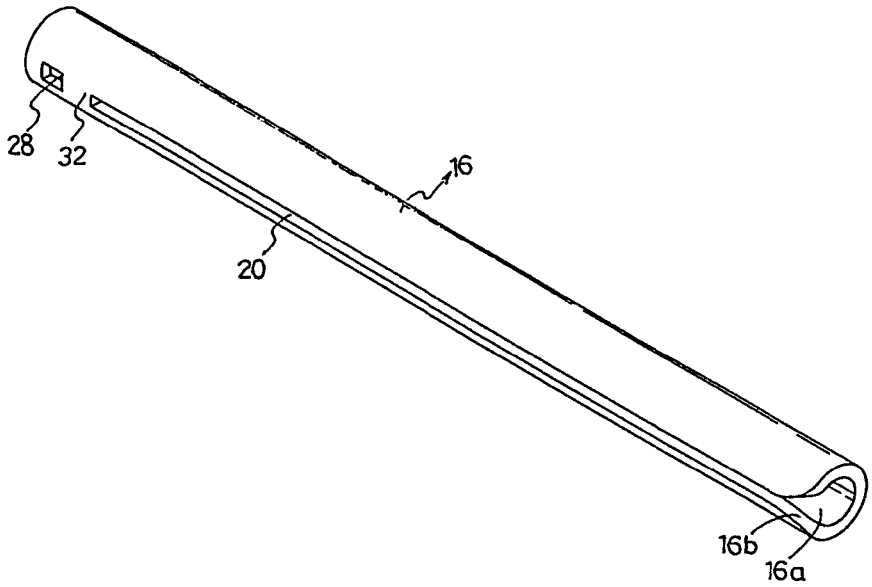
FIG. 3 is a perspective view illustrating a tubular member included in the pack sealing device according to the embodiment of the present invention.
Figure 4:
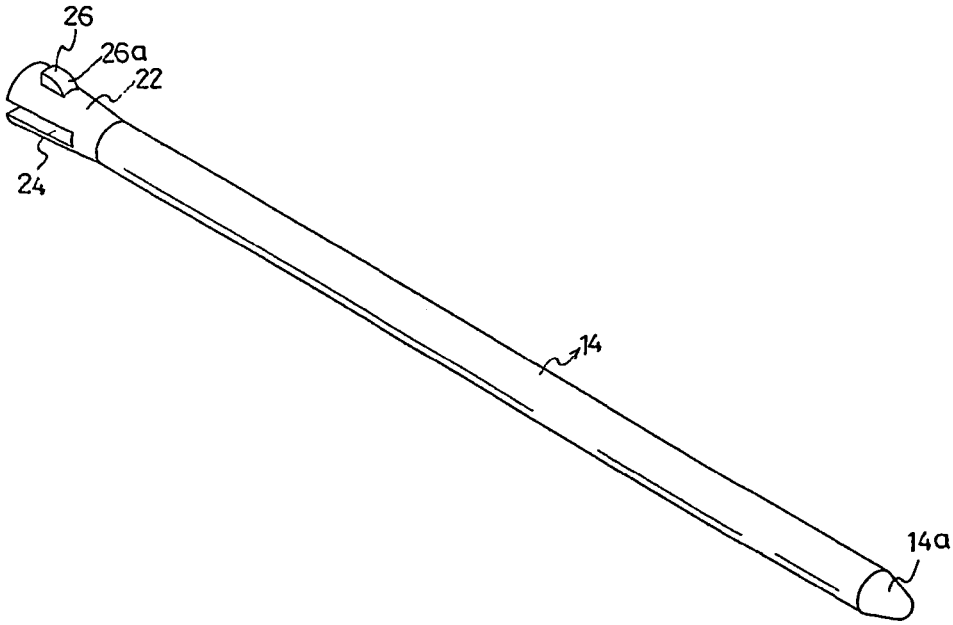
FIG. 4 is a perspective view illustrating a rod member included in the pack sealing device according to the embodiment of the present invention.
Figure 5:
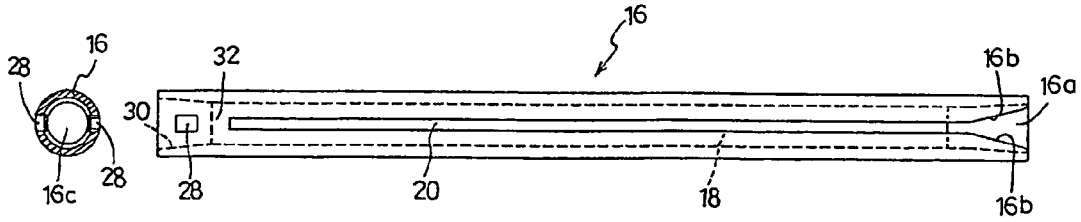
FIG. 5 illustrates, in the form of front and side views, the tubular member of the pack sealing device according to the embodiment of the present invention.
Figure 6:
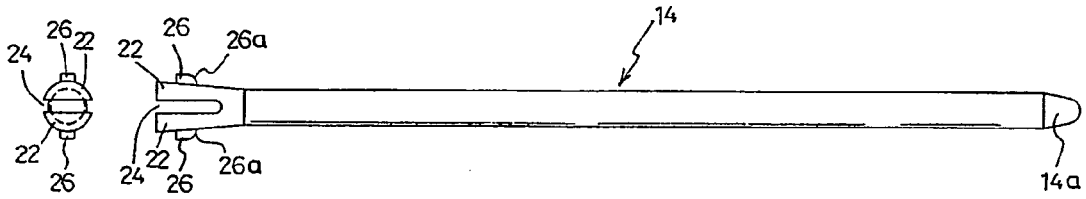
FIG. 6 illustrates, in the form of front and side views, the rod member of the pack sealing device according to the embodiment of the present invention.

The rod member 14 is coupled at its rear end to the rear end of the tubular member 16. Due to such a structure, the slit 20 does not extend to the rear end of the tubular member 16, as shown in FIGS. 2, 3 and 5. A connector 32 is formed at the rear end of the tubular member 16 where the slit 20 is not formed, so as to firmly couple the rod member 14 to the tubular member 16.

The rod member 14 has a constant outer diameter throughout the length thereof, except for its front end. At the front end thereof with which the pack 8 initially come into contact when it is to be coupled to the pack sealing device 2, the rod member 14 has a guide 14*a* having a tapered structure with a cross-sectional area gradually reduced as it extends toward its tip. In accordance with such a structure, the initial insertion of the opening portion of the pack 8 into the squeeze gap 18 can be easily carried out. The slit 20 is formed at its front end portion with facing inclined surfaces 16*b* gradually spaced away from each other as they extend to the front end of the slit 20. In accordance with such a structure of the slit 20, the initial insertion of the pack 8 into the pack sealing device 2 can be easily carried out.

In order to easily carry out the insertion of the opening portion of the pack 8 including the opening 4, the front end of the rod member 14 is slightly protruded beyond the front end of the tubular member 16. When it is desired to seal the pack 8 using the pack sealing device 2, it is desirable to wrap, around the front end of the rod member 14, the opening portion of the pack 8 in a state in which the opening 4 is closed, and then insert the opening portion of the pack 8 into the squeeze gap 18 and slit 20.

The squeeze gap 18 has a width corresponding to 2 to 10 times the thickness of the pack 8, so as to allow an easy insertion of the pack 8. Where the slit 20 has an excessively large width, it cannot seal the pack 8. Accordingly, the slit 20 preferably has a width slightly larger than that of the squeeze gap 18 so that the pack 8 is allowed to easily access the slit 20 in a folded state. Where the pack 8 has a small thickness, it may be folded to have a multi-ply structure for its sealing.

In accordance with the present invention, the tubular member 16 and/or the rod member 14 are made of a reinforced synthetic resin material which is not opaque, but transparent or semitransparent, so as to allow the user to identify, with the naked eye, the fitted state of the pack 8 or whether or not foreign matter is present in the squeeze gap 18.

The slit 20 has a length longer than the width W of the pack 8 or the width of the opening 4, as shown in FIG. 1, so as to completely seal the opening 4 of the pack 8.

The rod member 14 and tubular member 16 can be coupled to each other, using a diverse coupling structure.

Figure 7:
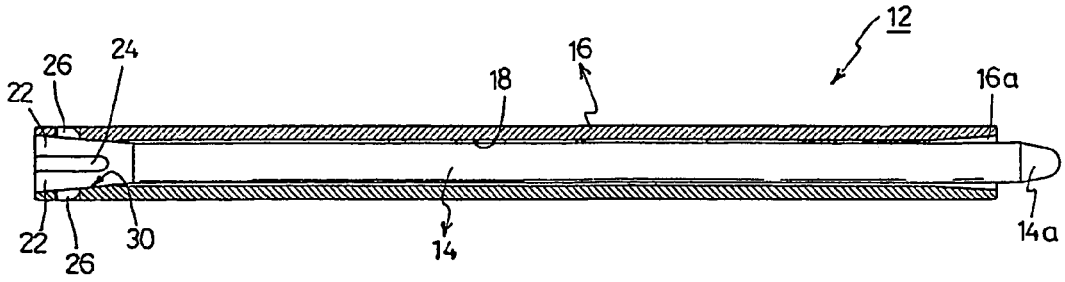
FIG. 7 is a cross-sectional view illustrating the pack sealing device according to the embodiment of the present invention.

For example, the coupling of the rod member 14 and tubular member 16 may be firmly achieved by means of a coupling structure using engagement protrusions and engagement holes, as shown in FIGS. 3 to 7. In this case, the rod member 14 is provided at its rear end with an enlarged extension. A horizontal slit 24 is centrally formed at the enlarged extension to extend in a longitudinal direction of the enlarged portion, so as to divide the enlarged extension into two portions 22. For convenience of description, the enlarged extension of the rod member 14 will be designated by the reference numeral 22 used to designate its divided portions. In accordance with this structure, the enlarged extension 22 has an elasticity in vertical and lateral directions. Small engagement protrusions 26 are centrally formed at the upper and lower portions of the outer surface of the enlarged extension 22, respectively. The tubular member 16 is provided at its rear end with a hollow enlarged extension 30 having a cross-sectional area increasing gradually as it is spaced away from the rear end of the tubular member 16, as shown in FIGS. 5 and 7. Engagement holes 28 are formed at portions of the enlarged extension 30 corresponding to portions of the enlarged extension 22 where the engagement protrusions 26 are formed, respectively. Each engagement protrusion 26 of the enlarged extension 22 has an inclined surface 26*a* adapted to come into contact with the rear end edge of the enlarged extension 30 when the enlarged extension 22 is inserted into the enlarged extension 30, thereby causing the enlarged extension 22 to have a reduced cross-sectional area. In accordance with this structure, the engagement of the engagement protrusions 26 with the engagement holes 28 can be easily achieved.

In this case, the coupling of the rod member 14 to the tubular member 16 can be achieved by fitting the front end of the rod member 14 in the enlarged extension 30 of the tubular member 16, and pushing the rod member 14 into the tubular member 16 until the engagement protrusions 26 are engaged with the engagement holes 30. In the coupled state, the squeeze gap 18 is defined between the rod member 14 and the tubular member 16. Thus, the pack sealing device 12 is completed.

Figure 8:
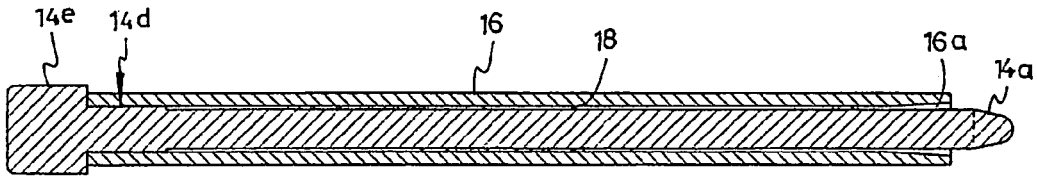
FIGS. 8 and 9 are cross-sectional views illustrating a pack sealing device according to another embodiment of the present invention.
Figure 9:
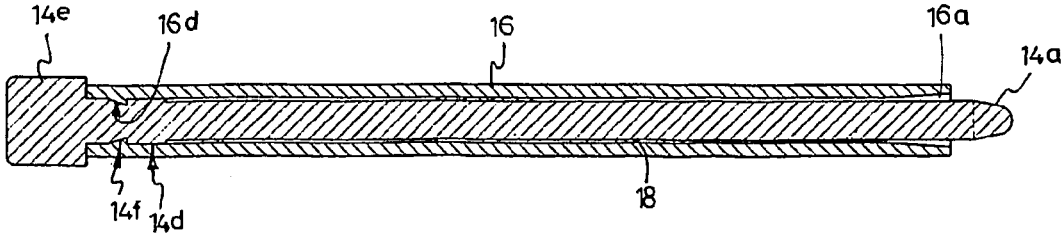
Figure 10:
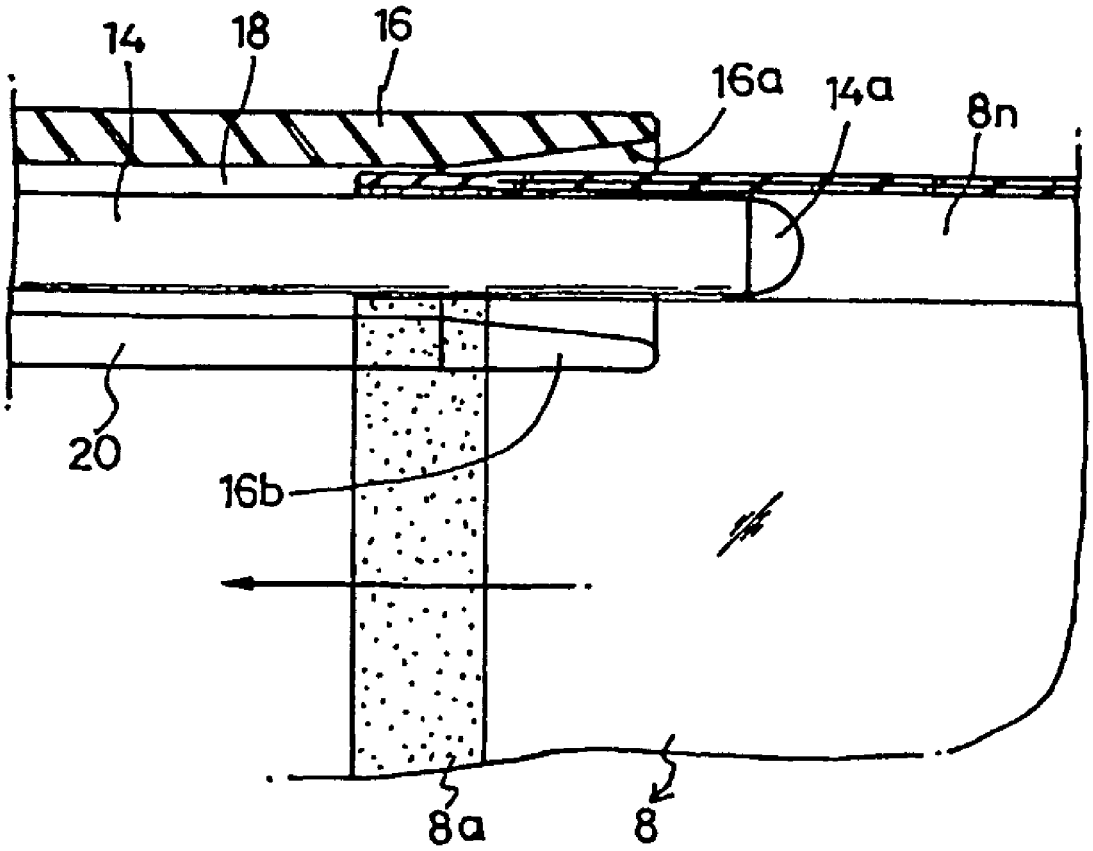
FIG. 10 is a cross-sectional view illustrating a procedure for sealing a pack by use of the pack sealing device according to the embodiment of the present invention.

FIGS. 8 and 9 illustrate another coupling structure for the rod member 14 and tubular member 16 to complete the pack sealing device 12.

In the case of FIG. 8, the rod member 14 is provided at its rear end with an enlarged extension 14*d*. The rod member 14 also has a knob 14*e* connected to the enlarged extension 14*d* while having a diameter larger than the enlarged extension 14*d*. In this case, the rod member 14 may be forcibly fitted in the rear end of the tubular member 16 at its rear end, bonded to the rear end of the tubular member 16 by use of an adhesive, or thermally fused to the rear end of the tubular member 16, so as to complete the pack sealing device 12.

By virtue of the knob 14*e*, it is possible to prevent the rod member 14 from being excessively inserted into the tubular member 16. The knob 14*e* also allows the user to conveniently use the pack sealing device 12. Where it is unnecessary to use the knob 14*e*, the rear end of the rod member 14 may be formed to have an outer diameter equal to the inner diameter of the tubular member 16. Alternatively, the portion of the rod member 14 corresponding to the knob 14*e* may be dispensed with.

As shown in FIG. 9, the enlarged extension 14*d* may be provided with an annular groove 14*f*. An annular protrusion 16*d* is also provided at the inner surface portion of the tubular member 16 such that it is engagable with the annular groove 14*f*. When the rod member 14 is forcibly fitted in the tubular member 16, the annular groove 14*f* and annular protrusion 16*d* are firmly engaged with each other.

The annular groove 14*f* has an inclined portion and a vertical portion. The vertical portion of the annular groove 14*f* faces toward the rear end of the associated rod member 14. Similarly, the annular protrusion 16*d* has an inclined portion and a vertical portion. The vertical portion of the annular protrusion 16*d* faces toward the front end of the associated tubular member 16. Since the knob 14*e* has an outer diameter larger than the outer diameter of the tubular member 16, it is possible to prevent the rod member 14 from being excessively inserted into the tubular member 16 to cause a state in which the engagement between the annular groove 14 and annular protrusion 16*d* is released.

Figure 11:
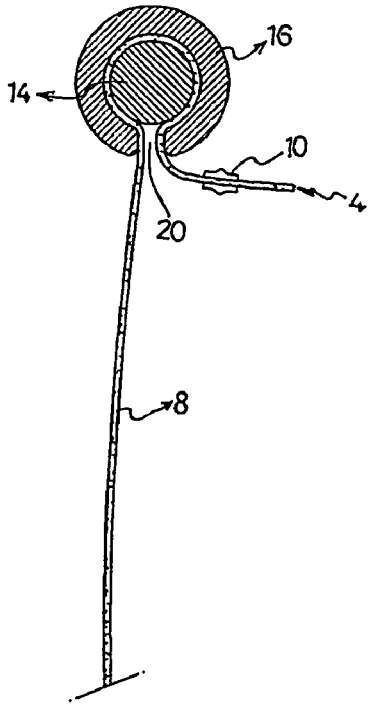
FIGS. 11 to 14 are cross-sectional views respectively illustrating use of pack sealing devices having different structures in accordance with various embodiments of the present invention.

FIG. 11 illustrates the case in which the cross-sectional shape of the rod member 14 is circular, semicircular, oval or semi-oval. In this case, the pack 8 is wrapped around the outer surface of the rod member 14, so that the squeezed or sealed area of the pack 8 is increased. In this case, the tubular member 16 preferably has a circular inner cross-sectional shape. However, the tubular member 16 may have an inner cross-sectional shape corresponding to the cross-sectional shape of the rod member 14. That is, the tubular member 16 may have a circular, semicircular, oval or semi-oval inner cross-sectional shape.

Figure 12:
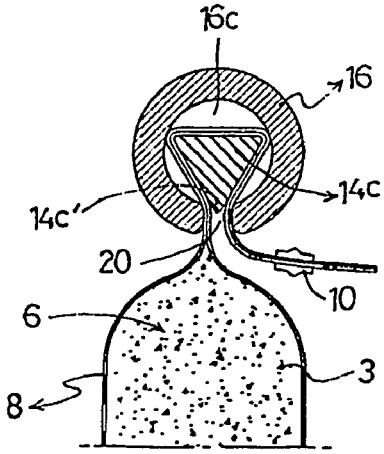

FIG. 12 illustrates the case in which a rod member 14*c* having a triangular cross-sectional shape is used. In this cases the rod member 14*c* is engaged with the slit 20 at its one corner 14*c*', so that a more tight sealing effect is obtained. In this case, the tubular member 16 may have a circular, semicircular or triangular cross-sectional shape in order to allow the rod member 14*c* to be inserted therein.

In the case of the rod member 14*c* having a triangular cross-sectional shape, a more tight sealing effect is obtained because the pack 8 is sharply bent at the corners 14*c*' of the rod member 14*c*, as compared to the case of FIG. 11 in which the rod member has a circular cross-sectional shape. That is, when the pressure applied to the pack 8 increases, the tension of the pack 8 increases in accordance with the function of the corner 14*c*' of the rod member 14*c* engaged with the slit 20, as shown in FIG. 12, so that the pack 8 is squeezed at the remaining corners 14*c*' of the rod member 14*c* under an increased pressure. In this state, the engagement between the slit 14 and the rod member 14*c* is more firmly achieved. In this case, accordingly, the effect for sealing the pack 8 is not lost even when an expansive pressure is applied to the pack 8 in accordance with the fermentation or aging of the food 3 received in the pack 8, or a high external pressure is applied to the pack 8.

Since the rod member 14 is engaged with the tubular member 16 at one corner thereof, it does not rotate even when the pack 8 expands by virtue of an internal or external pressure applied thereto, so that it does not lose its sealing effect.

The inner surface of the tubular member 16 and the outer surface of the rod member 14, between which the pack 8 is fitted, are made of a material having a certain lubricity, such as Teflon, so as to allow the opening portion of the pack 8 including the opening 4 to be easily slidably fitted therebetween.

Figure 13:
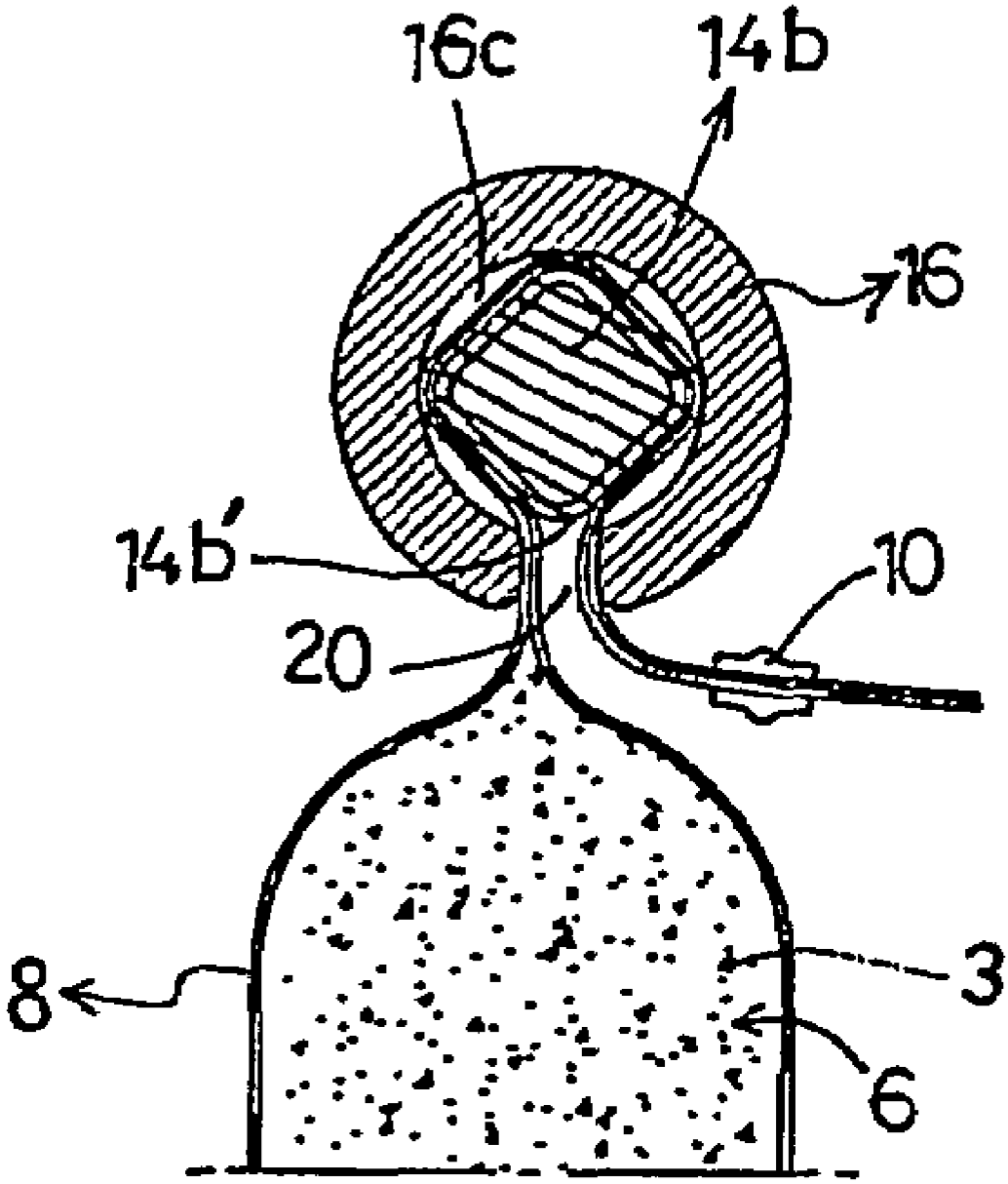
Figure 14:
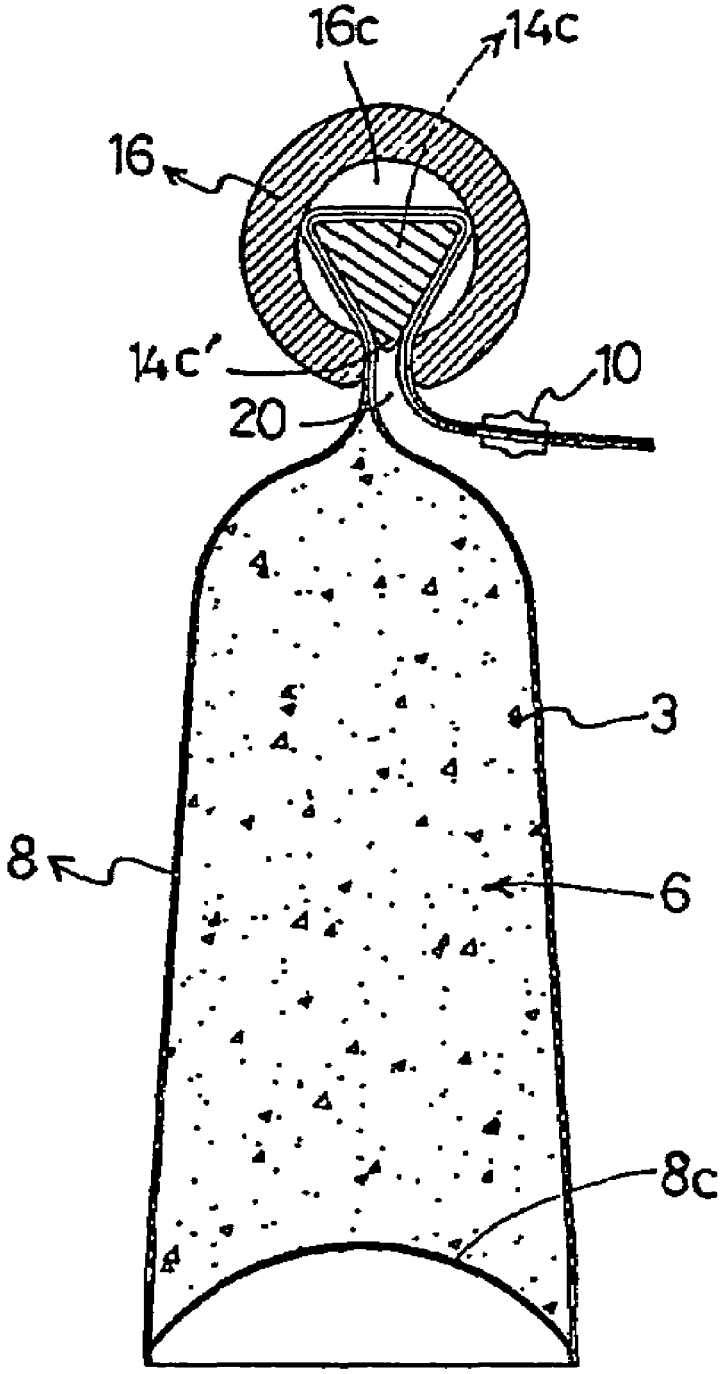

FIG. 13 illustrates the case in which a rod member 14*b* having a square cross-sectional shape is used. In this case, the rod member 14*b* is engaged with the slit 20 at its one corner 14*b*', so that a more tight sealing effect is obtained. In this case, the tubular member 16 may have a circular or square cross-sectional shape.

In the case of the rod member 14*b* having a square cross-sectional shape, a more tight sealing effect is obtained because the pack 8 is sharply bent at the corners 14*b*' of the rod member 14*b*, as compared to the case of FIG. 11 in which the rod member has a circular cross-sectional shape.

Figure 15:
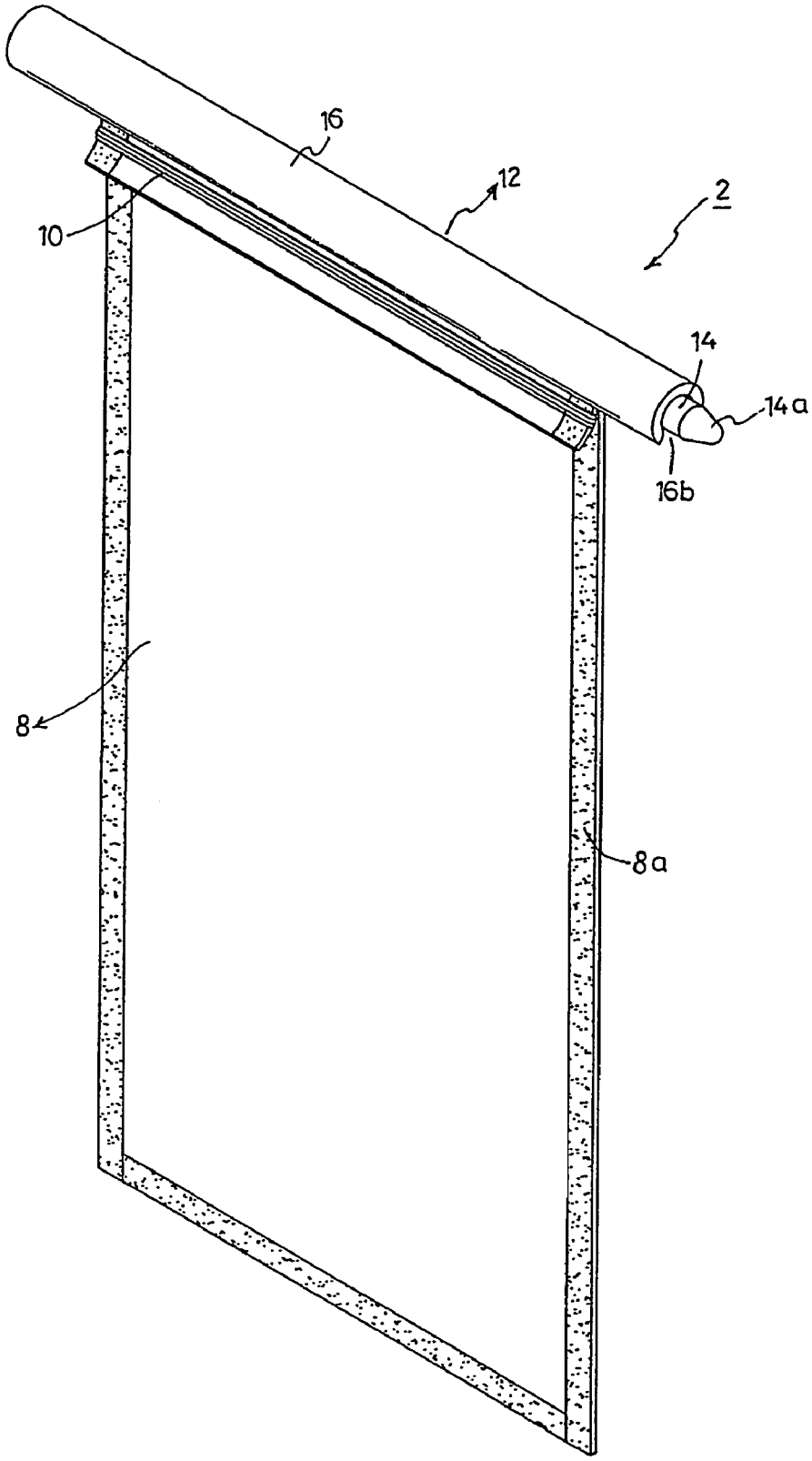
FIG. 15 is a perspective view illustrating use of the pack sealing device in accordance with another embodiment of the present invention.
Figure 16:
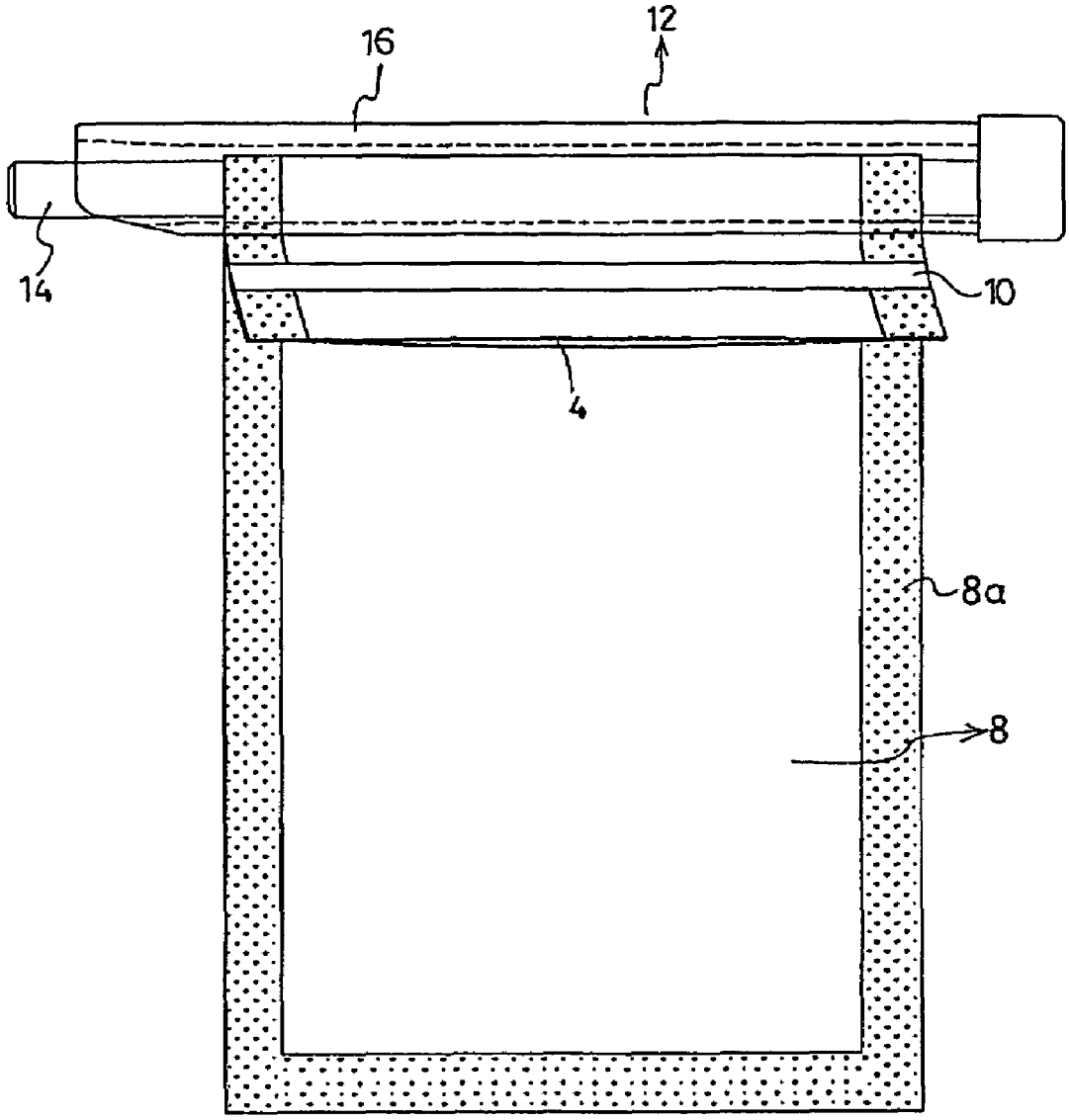
FIGS. 16 and 17 are front views illustrating use of the pack sealing device in accordance with another embodiment of the present invention, respectively.
Figure 17:
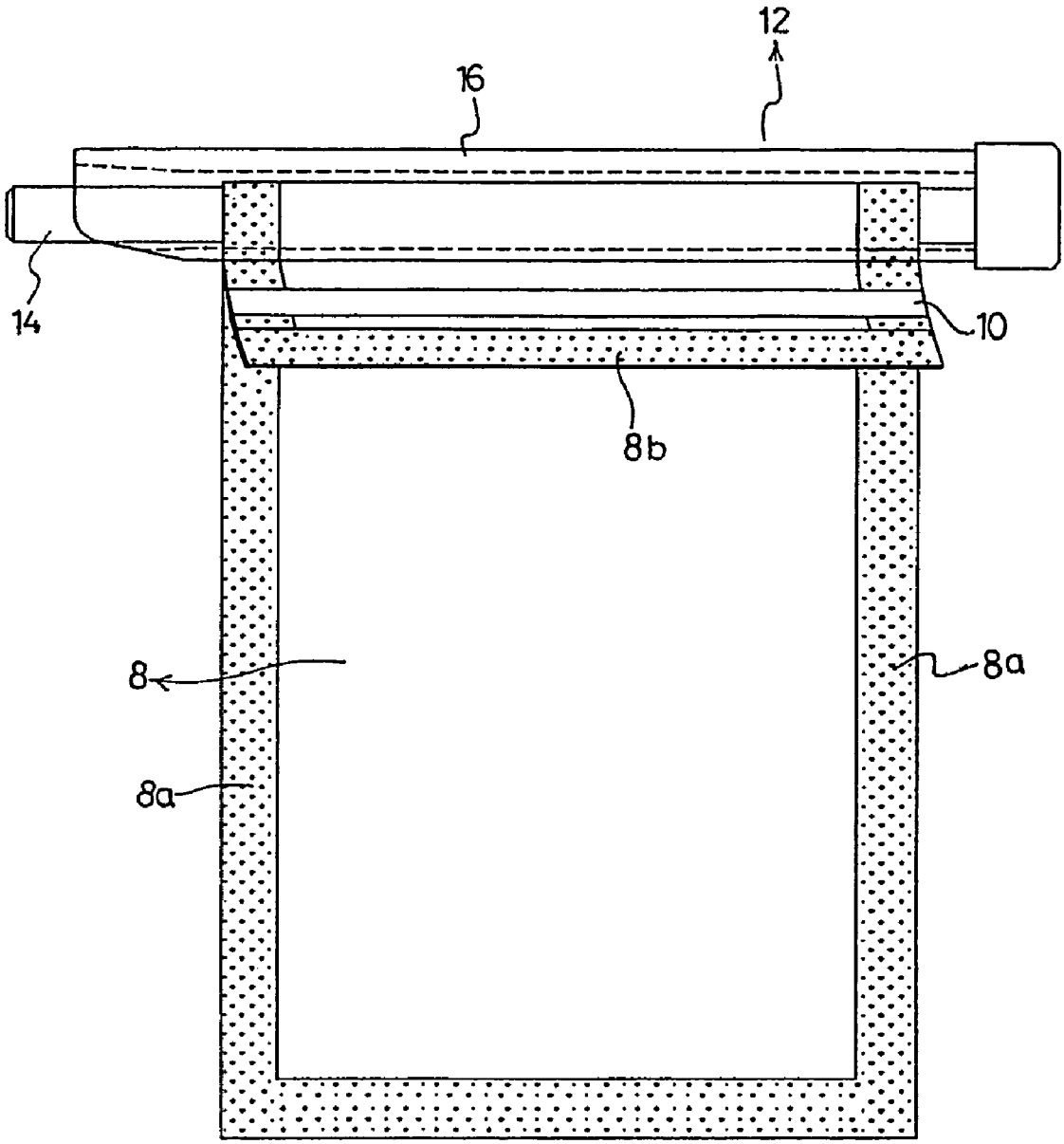

FIGS. 15 to 17 are perspective and front views illustrating the state in which the opening 4 of the pack 8 is sealed by the pack sealing device 12. In FIGS. 15 to 17, the pack 8 is shown in a state in which its contents are omitted.

The pack 8 shown in FIG. 15 has a pack structure which is mainly used in our daily life. The pack 3 can pack a food 3 in a sealed state. That is, the user can seal the pack 8 in a vacuum state by use of the pack sealing device 12 after opening the opening 4 of the pack 8, and putting a food 3 into the pack 8 through the opened opening 4. Where the contents of the pack 8 contain a large part of solid ingredients (solids), as in Kimchi, it is possible to store the contents of the pack 8 in a completely sealed state without causing gas from being introduced into the pack 8 or from being leaked from the pack 8. Thus, it is possible to maintain the freshness, smell and taste of Kimchi for a prolonged period of time.

FIG. 16 illustrates the case in which a material such as a food 3 is packed in the pack 8 at a factory (manufacturing place), and the opening 4 of the pack 8 is then sealed by the pack sealing device 12, so that the pack containing the material can be sold. FIG. 17 illustrates the case in which a material such as a food 3 is packed in the pack 8 at a factory or restaurant, and the opening 4 is sealed by means of a thermal fusing method or thermal pressing method, so that the pack containing the material can be sold. In this case, the pack 8 may be sold in a state in which the pack sealing device is coupled to the opening portion 4 of the pack 8 including the bonded or fused opening 4. Where a consumer desires to take out the contents of this pack 8, he may open the opening 4 of the pack 8 by means of a cutting or tearing method, as in conventional cases.

Once the opening 4 of the pack 8 is opened, as described above, the vacuum state or sealed state of the pack 8 is lost. In accordance with the present invention, however, the remaining contents of the pack 8 can be stored in a sealed or vacuum state by use of the pack sealing device 12 additionally provided in a state of being coupled to the pack 8. In this case, there is an advantage in that the contents of the pack 8 can be repeatedly taken out and stored in a vacuum or sealed state.

In accordance with the present invention, the pack 8 is preferably made of a vinyl film product for vacuum package formed by bonding, by use of a lamination method, a vinyl film having a dense structure, but having a low thermal fusibility, and a polyethylene (PE) film or polypropylene (PP) film having a less dense structure than that of the vinyl film, but being thermally fusible in accordance with a thermal fusing method. By virtue of such a film structure, it is possible to prevent gas or smell molecules from moving through the film structure of the pack 8.

Figure 18:
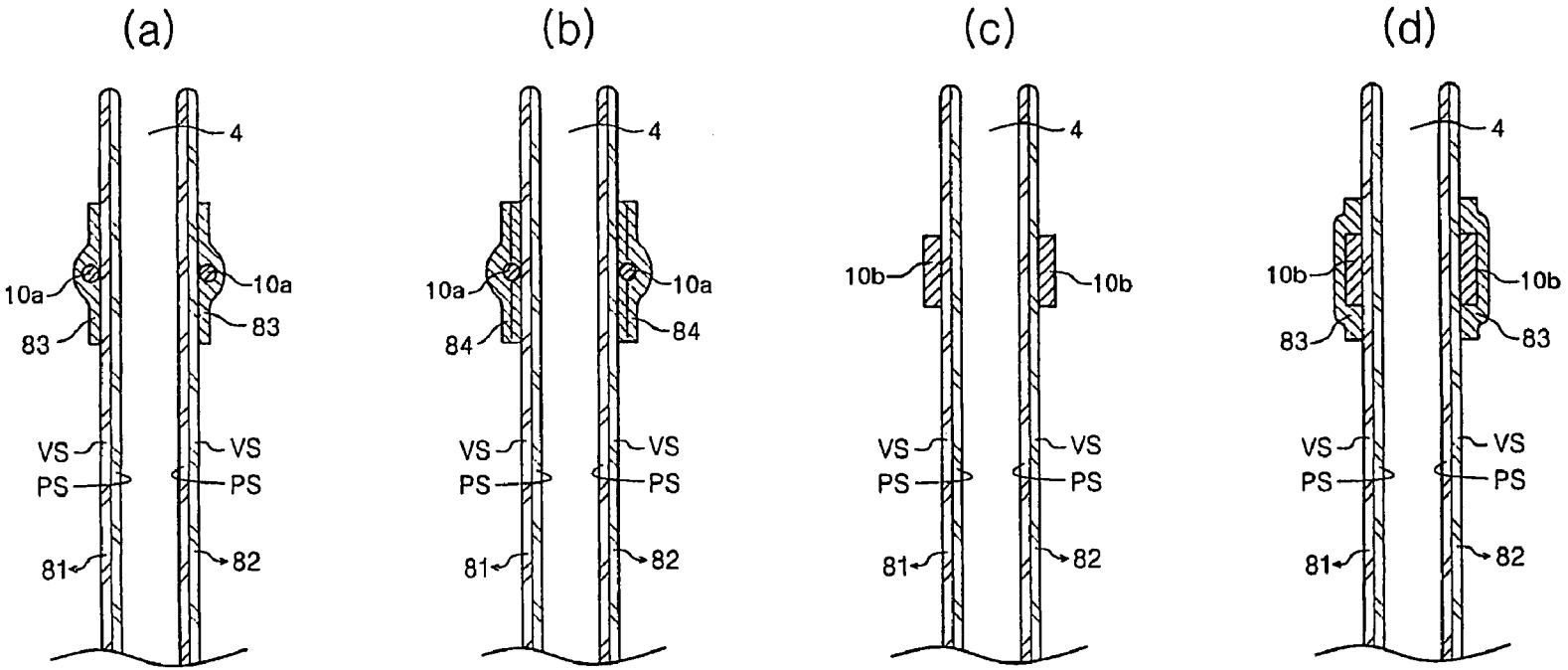
FIG. 18(*a*) to (*d*) are cross-sectional views respectively illustrating different structures of a shape retaining means in accordance with various embodiments of the present invention.
Figure 19:
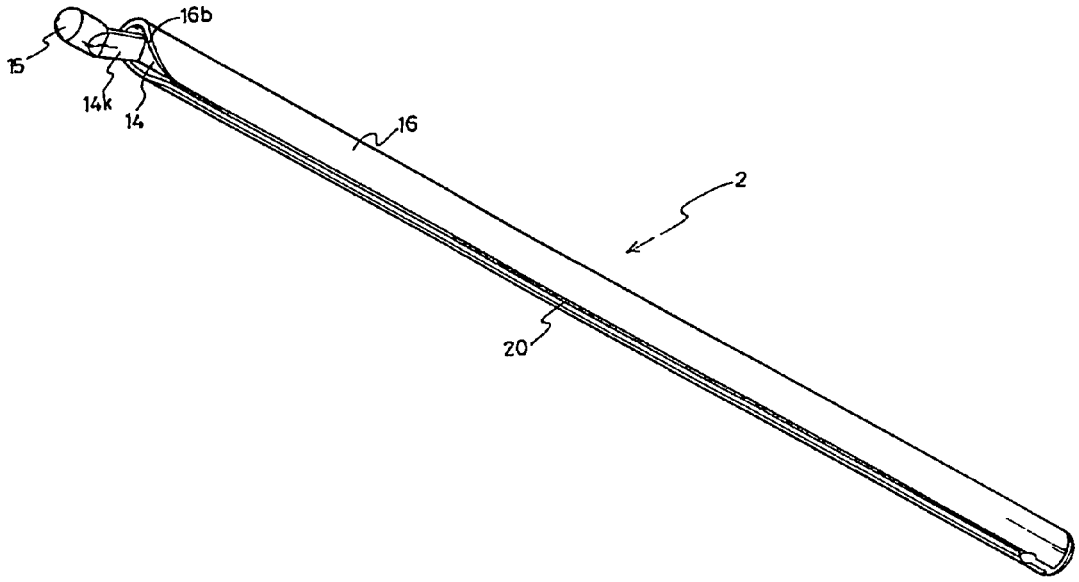
FIG. 19 is a bottom perspective view illustrating a pack sealing device according to another embodiment of the present invention.

That is, the pack 8 is manufactured to have a laminated structure, taking into consideration the fact that a vacuum pressure is applied to the pack 8, or an expansive pressure is applied to the pack 8 in accordance with the fermentation or aging of the food 3 received in the pack 8. For example, the pack 8 has a double-layer structure consisting of an outer film and an inner film, as shown in FIG. 18(*a*) to (*d*). Preferably, the outer film comprises a vinyl film having a dense structure to exhibit a low permeability of gas molecules, whereas the inner film comprises a polyethylene (PE) film or polypropylene (PP) film which is harmless to the human body while being easily thermally fusible, so that the inner and outer films can be bonded to each other. Thus, the pack 8 may be made of a general vinyl product for vacuum package.

Of course, the pack 8 may be made of other materials. The food 3 stored in the pack 8 may have a liquid phase, a solid phase, a gaseous phase, or a mixed phase thereof. Accordingly, the pack 8 is preferably made of a hygienic synthetic resin material (vinyl product or vinyl film) having a flexibility so that it is adaptable to the phase of the food 3. Also, the synthetic resin material preferably has a high toughness so that it sufficiently withstands a shrinkage pressure caused by vacuum or an expansion pressure. In addition, it is preferred that the pack 8 have diverse standard shapes and sizes, taking into consideration the volume for containing the food 3.

In accordance with the present invention, the pack 8 may be provided with a shape retaining means 10, as shown in FIG. 1. When the opening 4 of the pack 8 is widened to put a material into the pack 8 therethrough, the shape retaining means 10 retains the opening 4 in the widened state. Also, when the user pulls the opposite lateral ends of the opening 4 while grasping those lateral ends by the hands such that the lateral ends are moved away from each other, the opening 4 is closed. At this time, the shape retaining means 10 retains the opening 4 in the closed state. By virtue of the shape retaining means 10, it is unnecessary for the user to continuously grasp desired portions of the opening 4 by the hands in order to retain the opening 4 in the opened state.

The shape retaining means 10 is arranged in the vicinity of the opening 4 to extend along the opening 4. Preferably, the shape retaining means 10 extends in parallel to the opening 4. Of course, the shape retaining means 10 may extend inclinedly with respect to the opening 4. Also, the shape retaining means 10 may be formed to be integral with the pack 8.

Where the shape retaining means 10 is integral with the pack 8, it may be formed by forming a portion of the pack near the opening 4 to have an outwardly protruded structure having a thickness corresponding to 2 to 10 times the thickness of the pack 8 at other portions of the pack 8. Alternatively, a separate outer protrusion may be formed on the pack portion near the opening 4.

As shown in FIG. 1 and FIG. 18(*a*) to (*d*), the shape retaining means 10 may comprise a flexible wire 10*a* or flexible plate member 10*b*, which is easily bent when an external force is applied thereto, and retained at the bent state unless another external force is applied thereto. In order to protect or reinforce the wire 10*a* or plate member 10*b*, a separate synthetic resin sheath 83 or 84 may be bonded to the outer surface of the pack 8 such that it covers the wire 10*a* or plate member 10*b*.

The wire 10*a* is made of a soft metal wire or a synthetic resin wire, whereas the plate member 10*b* is made of a soft metal plate or a synthetic resin plate. Of course, the wire 10 and plate member 10*b* may be made of any other materials in so far as they can retain the opened state of the opening 4 established by an external force applied thereto. The size of the wire 10*a* and plate member 10*b* may be determined in accordance with the size of the pack 8 or the length of the opening 4, so as to retain the opened state of the opening 4.

Meanwhile, where the wire 10*a* or plate member 10*b* is partially or completely made of a metal or conductive material, there is a problem in that it is impossible to put the pack 8 into a microwave oven for cooking the contents of the pack 8. In this case, the wire 10*a* or plate member 10*b* may be heated by induction heat generated in the microwave oven, thereby causing the pack 8 to melt or fuse. In severe cases, the pack 8 may be burnt.

Therefore, in the case of a pack adapted to be used in a microwave oven, it is desirable that the wire 10*a* and plate member 10*b* are made of a material not influenced by induction heat, such as a synthetic resin.

Referring to FIG. 18(*a*) to (*d*), diverse structures of the shape retaining means 10 are illustrated. As shown in FIG. 18(*a*) and (*d*), wires 10*a* or plate members 10*b* made of an aluminum thin plate are attached to respective outer surfaces of the front and rear vinyl films 81 and 82 of the pack 8 by means of an adhesive or a thermal fusing or pressing method, so that they are integral with the pack 8.

Also, sheaths 84, in which wires 10*a* or plate members 10*b* made of an aluminum thin plate are embedded, may be attached to respective outer surfaces of the front and rear vinyl films 81 and 82 of the pack 8 by means of an adhesive or a thermal fusing or pressing method, so that they are integral with the pack 8, as shown in FIG. 18(*b*).

Alternatively, as shown in FIG. 18(*c*), plate members 10*b* may be attached to respective outer surfaces of the front and rear vinyl films 81 and 82 of the pack 8 by means of an adhesive or a thermal fusing or pressing method, so that they are integral with the pack 8. Thus, the shape retaining means 10 is completed.

The pack sealing device 12, which is adapted to seal the opening 4 of the pack 8, operates to bring the front and rear vinyl films 81 and 82 to come into tight contact with each other, thereby causing the pack 8 to be maintained in an airtight or watertight state.

The pack sealing device 12 is configured such that it is easily coupled to and separated from the pack 8. Accordingly, it is possible to easily achieve the vacuum or sealed state of the pack 8 or the vacuum or seal-released state of the pack 8. Also, the pack 8 can be repeatedly used.

Where the plate members lob are made of a synthetic resin material, they may have a plate structure having a thickness and elasticity similar to those of a pad adapted to be inserted under a notebook. As the plate members 10*b* having such a structure are attached to the pack 8, it is possible to achieve a desired shape retention of the opening 4.

In the above described cases, the elasticity, thickness, width and flexibility of the plate members 10*b* are appropriately adjusted, based on the volume (capacity) of the pack 8 or the length of the opening 4, so as to retain an optimum opening shape. In the case of the wires 10*a*, their design conditions are determined in the same manner as described above.

Where the shape retaining means 10 is to be integral with the pack 8, it may be formed by forming a portion of the pack near the opening 4 to have an outwardly protruded structure having a thickness corresponding to 2 to 10 times the thickness of the pack 8 at other portions of the pack 8. Alternatively, a separate outer protrusion may be formed on the pack portion near the opening 4.

Figure 23:
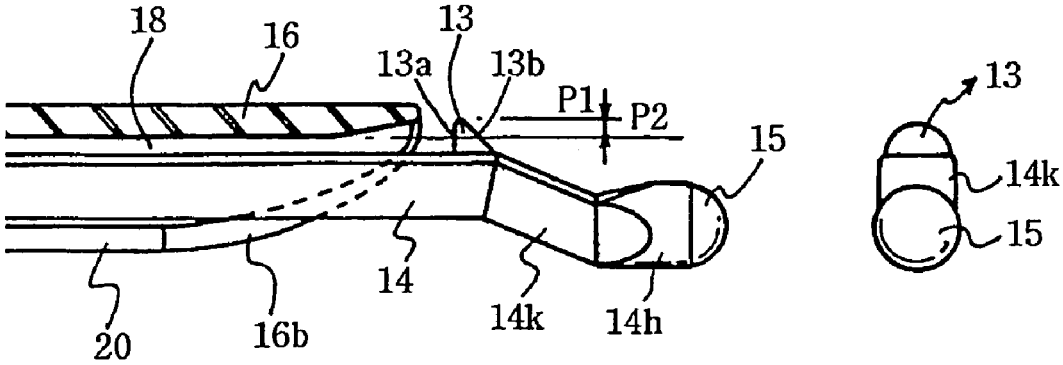
FIG. 23 is a cross-sectional view illustrating a pack sealing device modified from that of FIG. 22 in accordance with the present invention.
Figure 24:
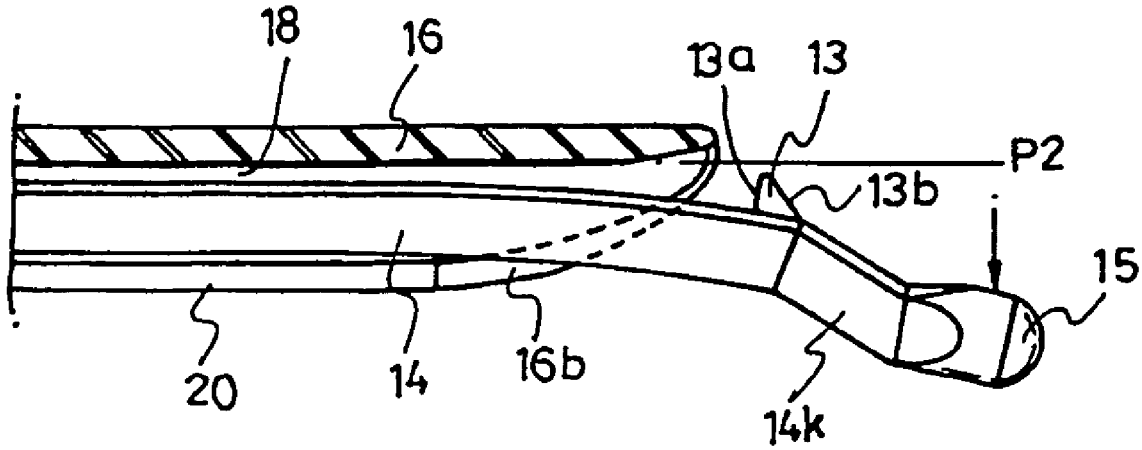
FIG. 24 is a cross-sectional view illustrating an operation of the rod member shown in FIG. 23 in accordance with the present invention.
Figure 25:
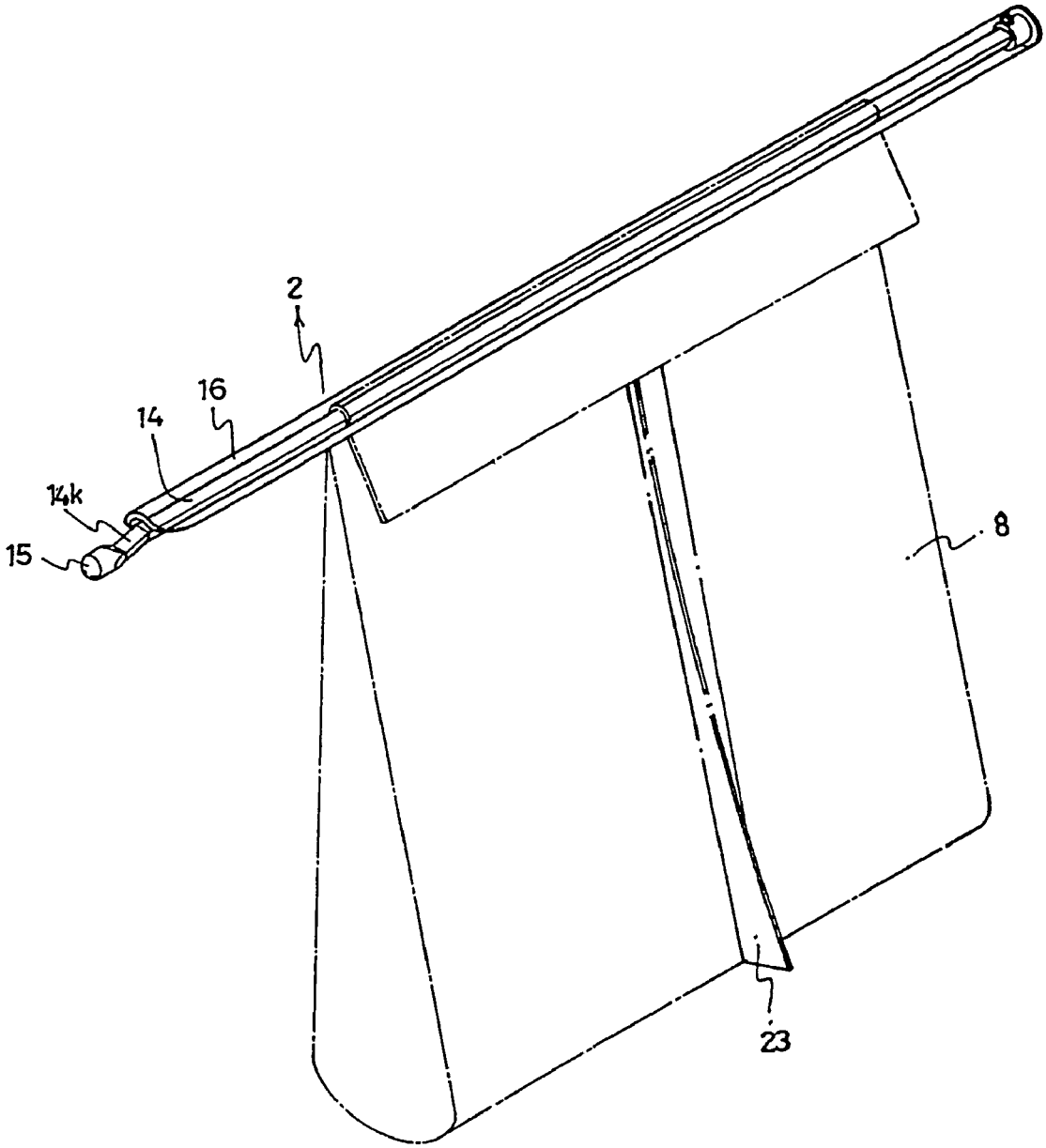
FIG. 25 is a perspective view illustrating use of the pack sealing device shown in FIG. 19 in accordance with the present invention.

FIGS. 19 to 27 illustrate the case in which a bent portion 14*k* is formed at the front end of the rod member 14 included in the pack sealing device 2 in accordance with the present invention, so as to more easily achieve the coupling of the pack 8 to the pack sealing device 2. Where the rod member 14 of the pack sealing device 2 does not have such a bent portion, and the pack 8 has a vertical seam 23 at its central portion, as shown in FIG. 25, the vertical seam 23 may be caught by the front end of the rod member 14 during an insertion of the pack 8 into the pack sealing device 2. In order to solve such a problem, the bent portion 14*k* is formed at the front end of the rod member 14. A horizontal extension 14*h* is also provided at a front end of the bent portion 14*k*. Also, a round or semicircular protrusion 15 is formed at a front end of the horizontal extension 14*h*. In accordance with such a structure, it is possible to prevent the seam 23 from being caught by the front end of the rod member 14 when the pack 8 is inserted into the pack sealing device 2. Thus, the operation for sealing the pack 8 can be easily achieved.

The round or semicircular protrusion 15 formed at the front end of the horizontal extension 14*h* not only guides an easy insertion of the pack 8 into the pack sealing device 2 for sealing thereof, but also prevents the user or persons positioned around the pack sealing device 2 from being injured by the rod member 14 while preventing articles positioned around the pack sealing device 2 from being damaged by the rod member 14.

Meanwhile, the pack 8 coupled to the pack sealing device 2 may slide along the rod member 14 during a movement thereof from one location to another location or by an external force intentionally or unintentionally applied to the pack 8 or pack sealing device 2, so that it may be separated from the pack sealing device 2. In order to prevent such a problem, a stopper 13 may be formed at a portion of the rod member 14 arranged slightly beyond the tubular member 16 such that it extends upwardly from the rod member 14, as shown in FIG. 23. When the pack 8 is coupled to the pack sealing device 2 in a sealed state, its edge arranged toward the front end of the rod member 14 is caught by the stopper 13. Thus, the above described problem is eliminated.

The stopper 13 has, at one side thereof, a vertical surface 13*a* facing toward the squeeze gap 18 so as to restrain a separation of the pack from the pack sealing device 2. The stopper 13 also has, at the other side thereof opposite to the vertical surface 13*a*, an inclined surface 13*b* adapted to make the pack 8 be easily inserted into the pack sealing device 2.

As shown in FIG. 23, the upper end of the stopper 13 is normally arranged at a level, indicated by the line P1, slightly higher than the level of the squeeze gap 18 indicated by the line P2, so as to allow the stopper 13 to be sufficiently engaged with the facing edge of the pack 8.

Where it is desired to separate pack 8 from the pack sealing device 2, the user depresses the front end of the rod member 14, as indicated by an arrow in FIG. 24, such that the upper end of the stopper 13 is positioned at a level lower than the level of the squeeze gap 18 indicated by the line P2. In this state, the stopper 13 is disengaged from the facing edge of the pack 8. Accordingly, it is possible to easily separate the pack 8 from the pack sealing device 2.

Figure 20:
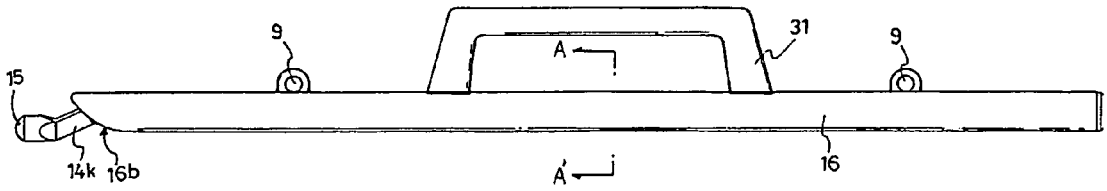
FIG. 20 is a front view illustrating a pack sealing device according to another embodiment of the present invention.
Figure 21:
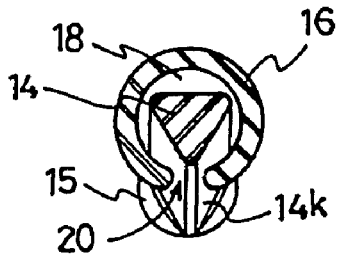
FIG. 21 is a cross-sectional view taken along the line A-A' of FIG. 20.
Figure 22:
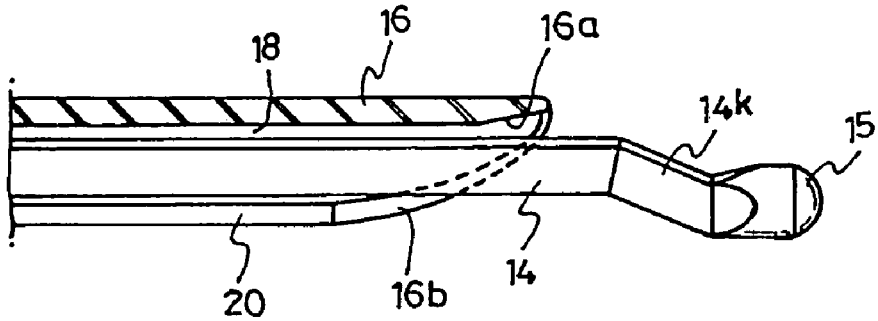
FIG. 22 is a cross-sectional view illustrating a tip portion of the pack sealing device shown in FIG. 19.
Figure 26:
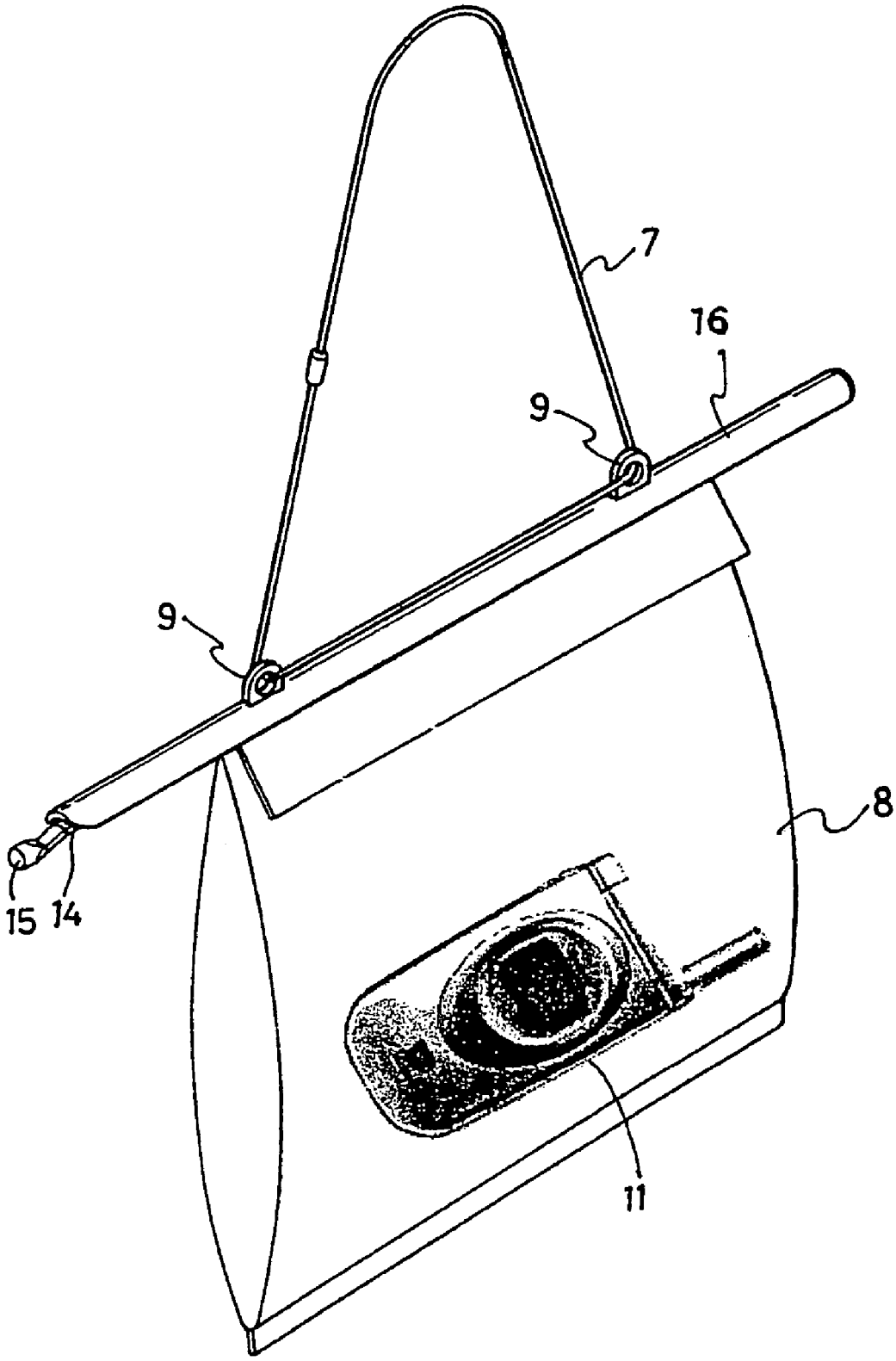
FIGS. 26 and 27 are perspective views each illustrating a pack sealing device according to another embodiment of the present invention.
Figure 27:
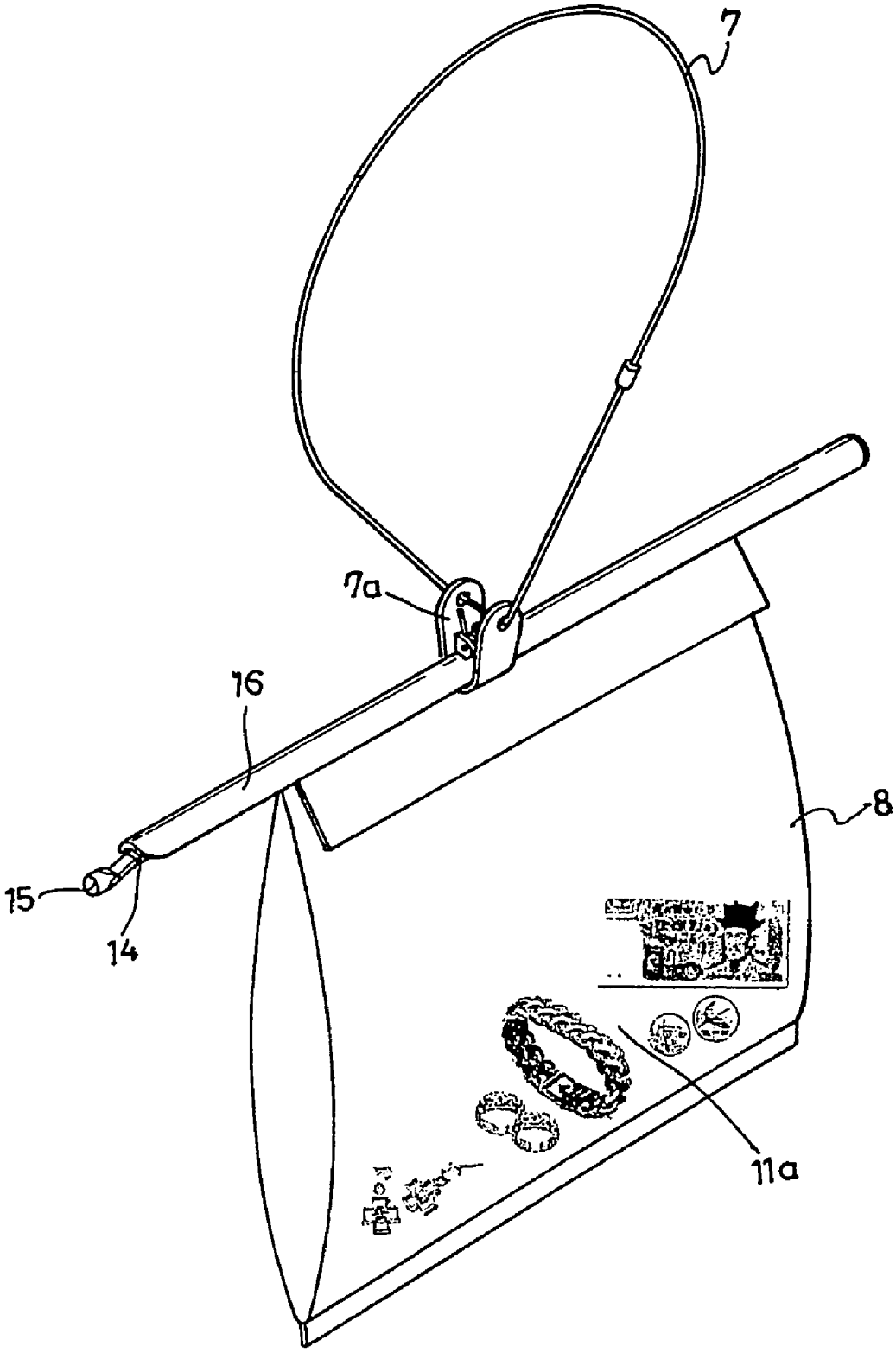

As shown in FIG. 20, one or more rings 9 may be attached to the upper portion of an outer surface of the tubular member 16, in order to connect a string or necklace 7 to the tubular member 16. Under the condition in which the string or necklace 7 is connected to the rings 9 of the tubular member 16, it is possible to stably carry or store the contents of the pack. For instance, as shown in FIG. 26 or 27, after the user receives, in the pack 8 through the opening 4, cash or valuables 11*a*, or an electronic appliance, which may be easily damaged by moisture and dust while being liable to be lost, for example, a mobile phone 11, and then seals the pack 8 by use of the pack sealing device 2, he may wear the pack 8 on the neck via the string or necklace 7 to carry the pack 8 or hang the pack 8 on a wall to store the pack 8. In this case, it is possible to prevent an electronic appliance such as the mobile phone 11, or cash or valuables 11*a* from being wet, lost, damaged in a watering place or swimming beach.

Also, a handle 31 may be provided at a central portion of the tubular member 16, as shown in FIG. 20, so as to allow the user to carry the pack 8 by the hand. Of course, both the rings 9 and the handle 31 may be provided at the tubular member 16. The handle 31 may have a detachable structure.

In place of the rings 9, a separate clip 7*a*, to which, the string or necklace 7 is connected, may be detachably mounted to the central portion of the tubular member 16, as shown in FIG. 27. In this case, the same effect as in the case of FIG. 26 is obtained.

Figure 28:
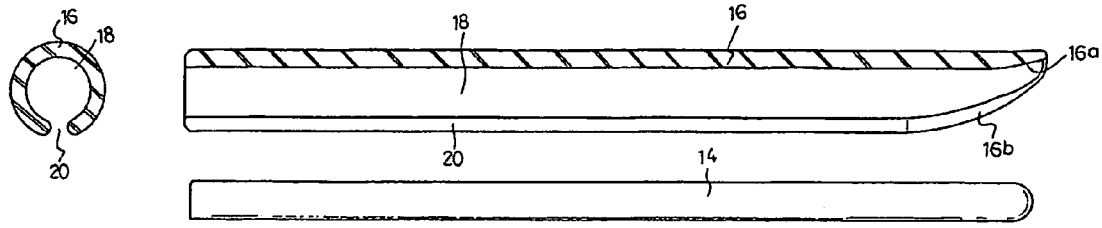
FIG. 28 is an exploded cross-sectional view illustrating a pack sealing device according to another embodiment of the present invention.
Figure 29:
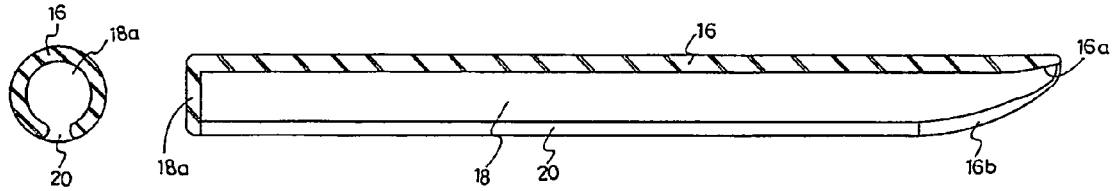
FIG. 29 is an exploded cross-sectional view illustrating a pack sealing device according to another embodiment of the present invention.
Figure 30:
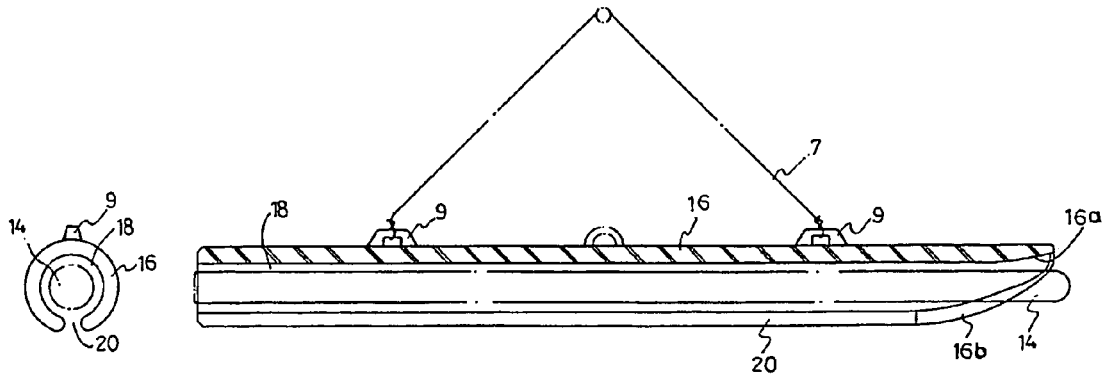
FIG. 30 is a cross-sectional view illustrating a pack sealing device according to another embodiment of the present invention.

FIGS. 28 to 30 illustrate the case in which the rod member 14 and tubular member 16 of the pack sealing device 2 are separable from each other. In this case, the rear end of the tubular member 19 may have an open structure as shown in FIG. 28, or a closed structure as shown in FIG. 29. In the latter case, an end member 18*a* is provided at the rear end of the tubular member 16. By virtue of the end member 18*a*, it is possible to prevent the rod member 14 from extend excessively beyond the rear end of the tubular member 16 upon sealing the pack 8.

In the case of FIG. 30, the rings 9 are attached to the upper portion of the outer surface of the tubular member 16, in order to connect a string or necklace 7 to the tubular member 16. In this case, it is possible to stably carry or store cash or valuables 11*a*, or an electronic appliance, for example, a mobile phone 11, as described above.

Figure 31:
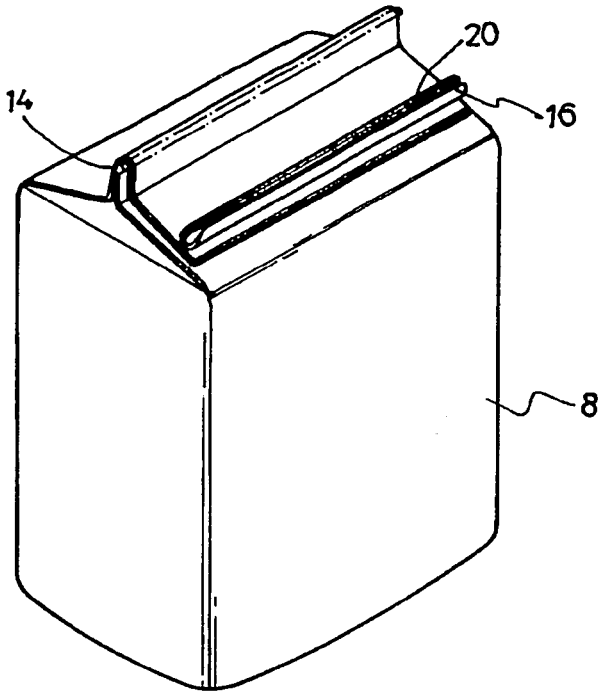
FIG. 31 is a perspective view illustrating use of the pack sealing device shown in FIG. 28 in accordance with the present invention.
Figure 32:
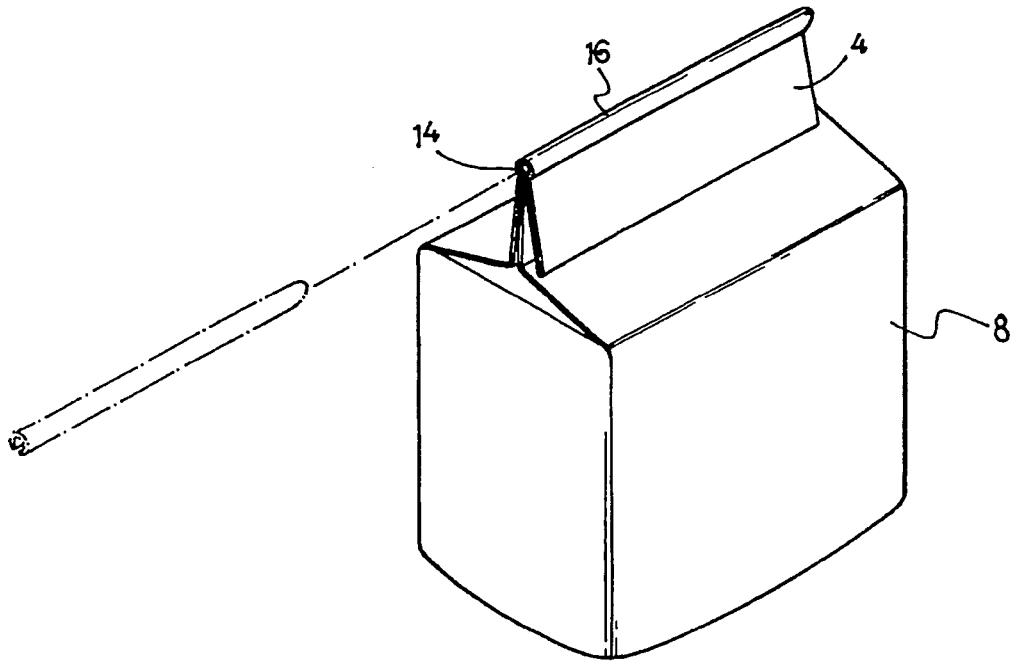
FIG. 32 is a perspective view illustrating a procedure for coupling the pack sealing device of FIG. 31 to a pack in accordance with the present invention.

FIGS. 31 and 32 illustrate the case in which the rod member 14 is formed to be integral with the pack 8, or bonded or fused to the pack 8. That is, the rod member 14, which has the same length as that of the opening 4 of the pack 8, is fixedly attached to a desired portion of the outer surface of the pack 8 in the vicinity of the opening 4. In this case, the tubular member 16 is also detachably attached to a desired portion of the outer surface of the pack 8 in the vicinity of the opening 4. When the user desires to take out the contents of the pack 8, he opens the opening 4 of the pack 8. After taking out a desired amount of the contents from the pack 8, the user detaches the tubular member 16 from the pack 8, wraps the rod member 14 by the opening portion of the pack 8, and then slidably fits the tubular member 16 around the rod member 14 wrapped by the opening portion of the pack 8. Thus, the pack 8 is sealed by the pack sealing device 2. As the above described procedure is repeatedly carried out, the contents of the pack 8 can be repeatedly taken out and stored in a sealed state.

Figure 33:
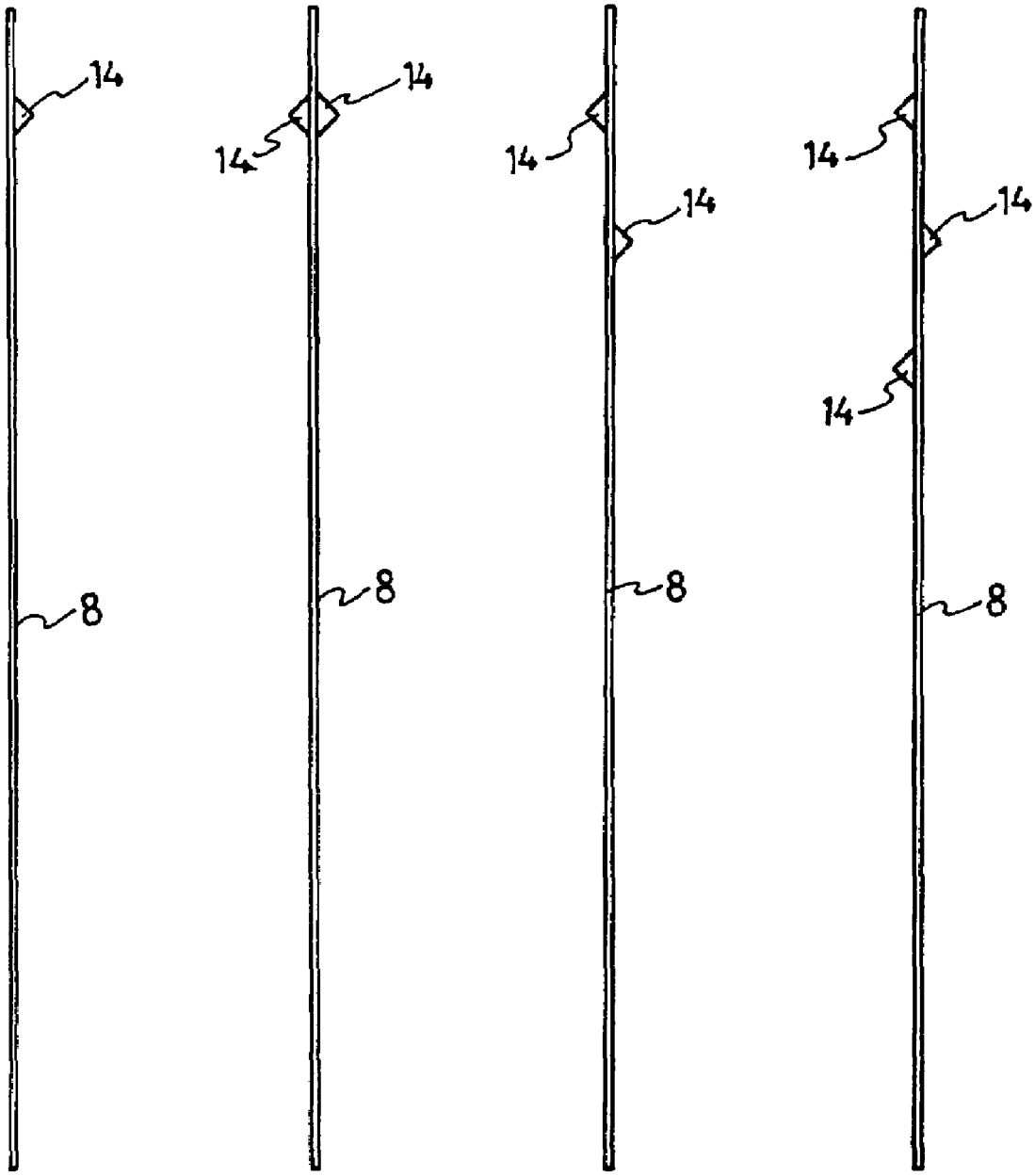
FIG. 33 is a side view illustrating packs to which one or more rod members are attached at diverse positions, respectively, in accordance with the present invention.
Figure 34:
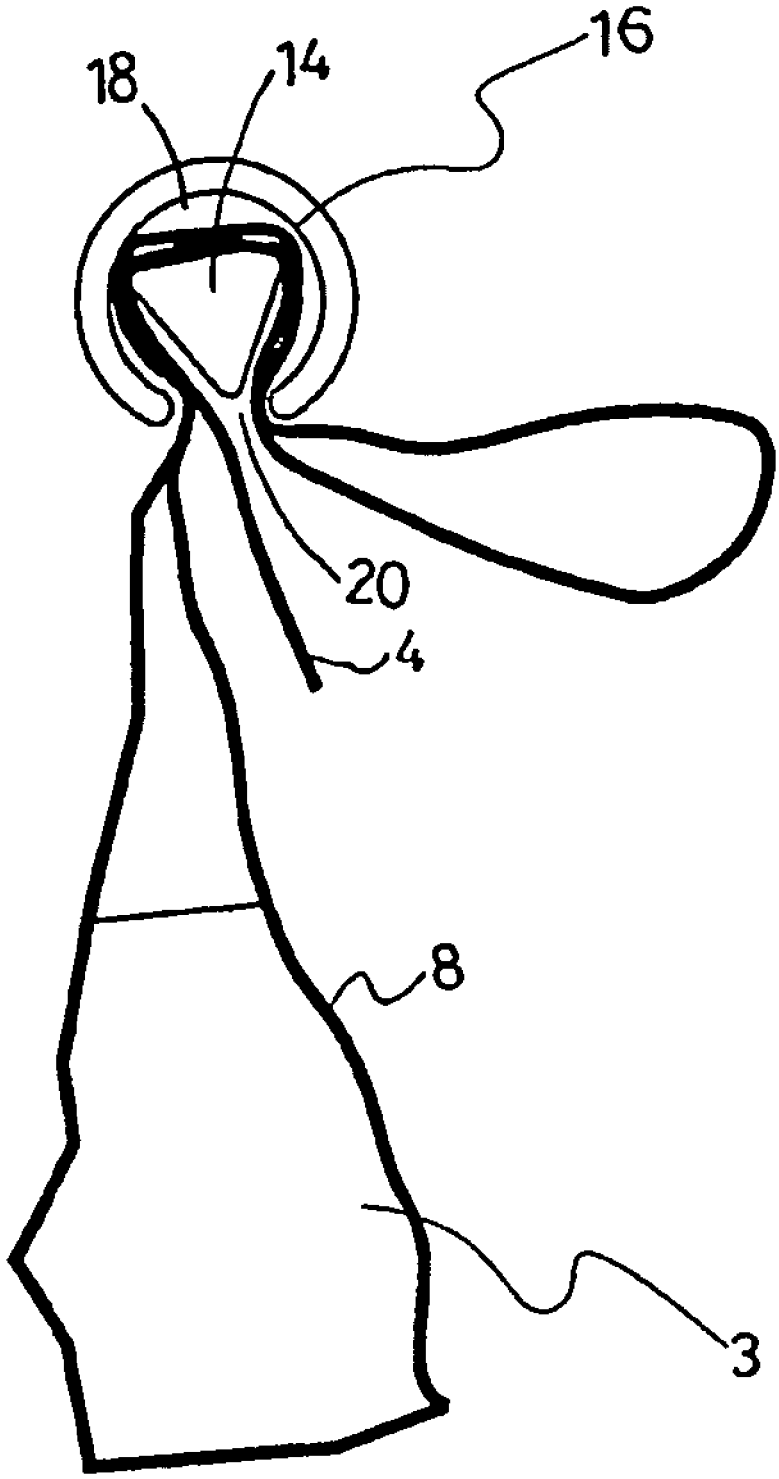
FIG. 34 is a cross-sectional view illustrating a state in which the opening portion of the pack are folded into several plies so that it is sealed by the pack sealing device in accordance with the present invention.

As shown in FIG. 33, one or more rod members 14 may be attached to one outer surface or each outer surface of the pack 8. Where two or more rod members 14 are attached to one outer surface or each outer surface of the pack 8, they may be arranged at the same level to face each other, or at different levels in a zig-zag fashion. In this case, it is possible to vary the position where the pack 8 is sealed by the pack sealing device, in accordance with the level of the contents in the pack 8.

Where the opening portion of the pack 8 including the opening 4 has a small thickness, it may be wrapped around the rod member 14 in a state of being folded into two, three, or four plies, as shown in FIG. 34, so as to achieve a tight seal.

Figure 35:
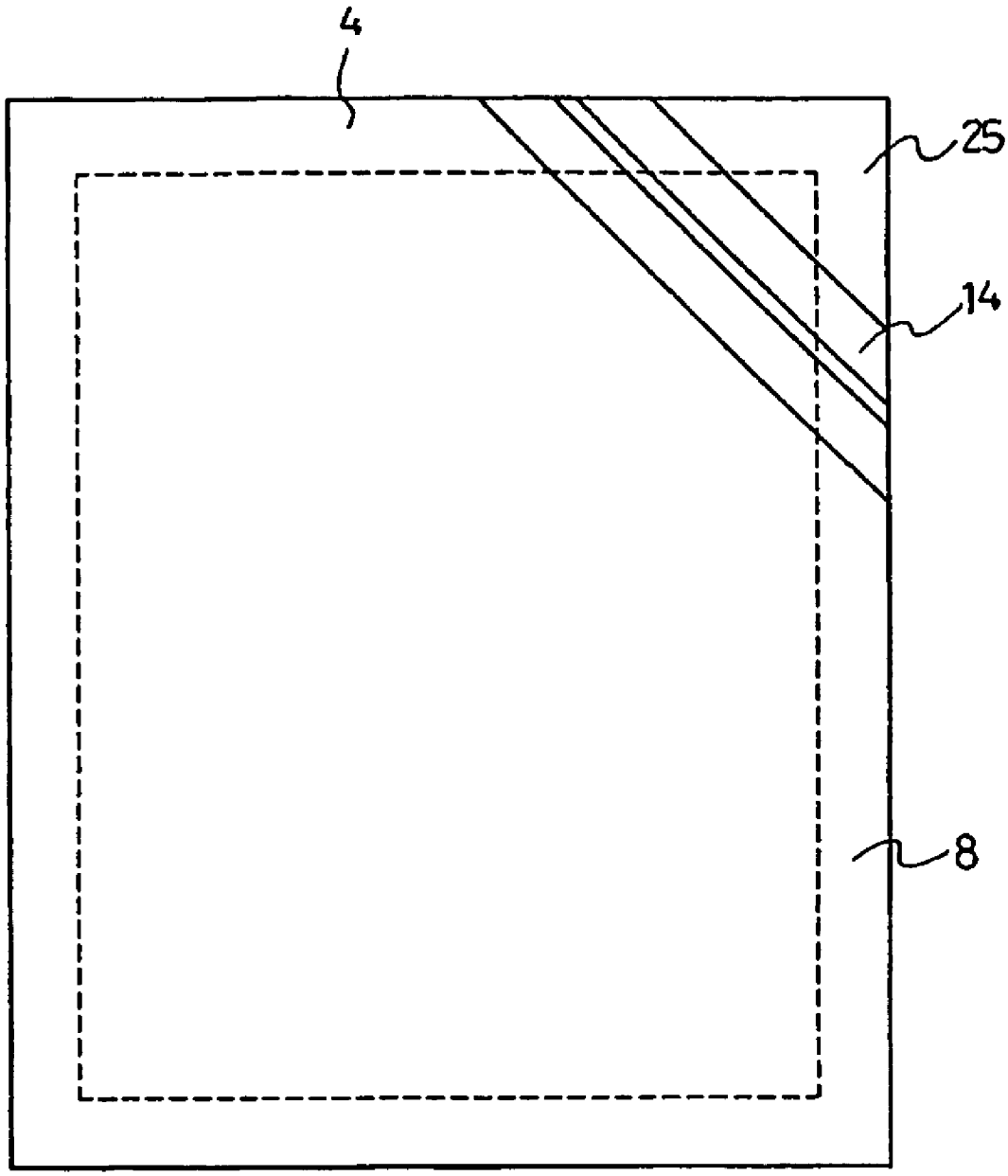
FIG. 35 is a front view illustrating a rod member attached to a portion of the pack near one corner of the pack in accordance with another embodiment of the present invention.

Typically, the rod member 14 is attached to the pack 8 such that it extends in parallel to the opening 4. However, the rod member 14 may be attached to one corner portion 25 of the pack 8 near one end of the opening 4 such that it extends inclinedly with respect to the opening 4, as shown in FIG. 35, in order to provide an effective sealing effect in the case in which the opening portion of the pack 8 is inclinedly cut or tore to open the opening 4 at one end thereof so that the user can conveniently take out the contents of the pack 8.

As the rod member 14 is fixedly attached to the pack 8 at one side of the opening 4, and the tubular member is separably fitted around the rod member 14, it is possible to seal the pack 8.

Figure 36:
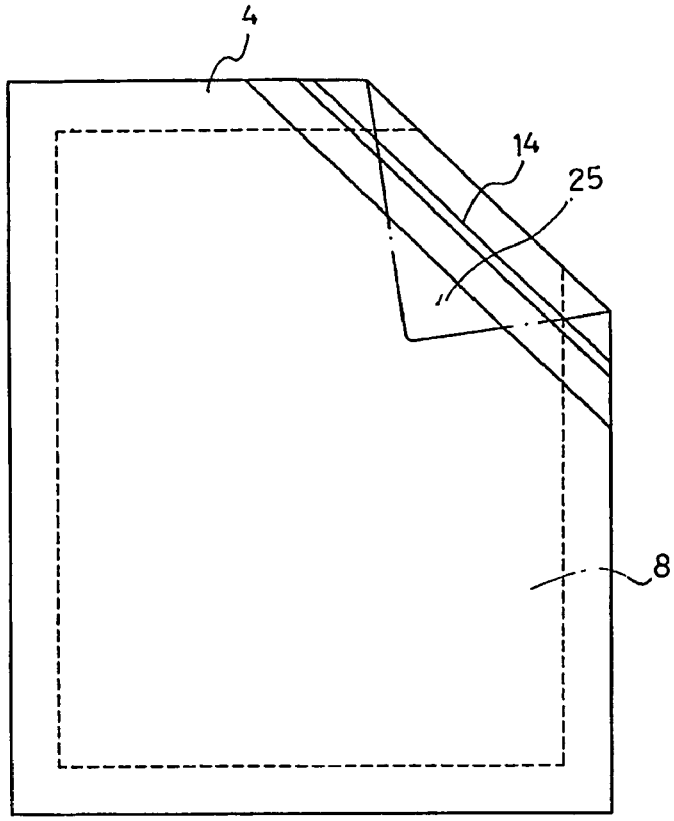
FIG. 36 is a front view illustrating a state in which the rod member is wrapped by the corner portion of the pack in the case of FIG. 35 in accordance with the present invention.
Figure 37:
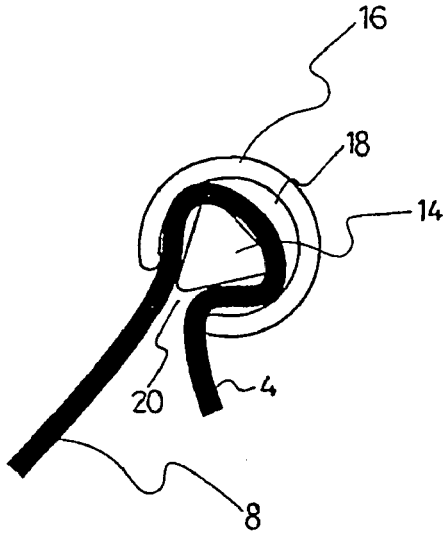
FIG. 37 is a cross-sectional view illustrating a sealed state in the case of FIG. 35 in accordance with the present invention.
Figure 38:
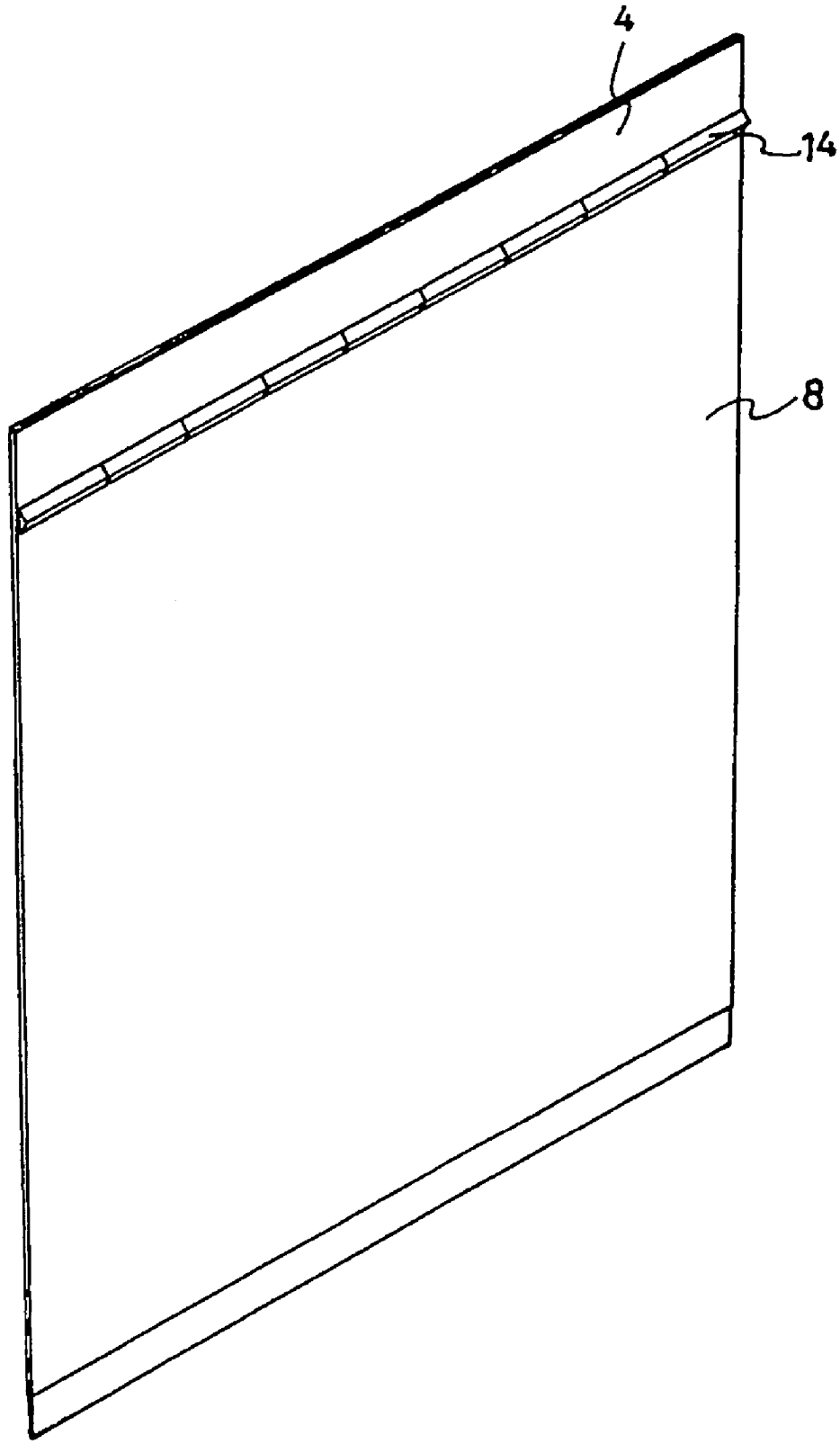
FIG. 38 is a perspective view illustrating a rod member formed with grooves and bonded to the outer surface of the pack in accordance with another embodiment of the present invention.

In this case, the sealing of the pack 8 is achieved by wrapping the corner portion 25 of the pack 8 around the rod member 14, as shown in FIG. 36 and then slidably fitting the tubular member 16 around the rod member 14 wrapped by the pack portion, as shown in FIG. 37. Since the opening 4 is opened at the corner portion 25 of the pack 8, it is possible to conveniently take out the contents of the pack 8. Of course, the contents of the pack 8 can be repeatedly taken out and stored in a sealed state.

In accordance with the present invention, the rod member 14, which is adapted to be attached to the outer surface of the pack 8, may have a diverse cross-sectional shape. For example, the rod member 14 may have a circular, semicircular, triangular, rectangular, or polygonal cross-sectional shape, an oval cross-sectional shape having a stopper structure, or a modified cross-sectional shape thereof. Since the rod member 14 is adapted to be bonded or fused to the outer surface of the pack 8, it is preferred that the surface of the rod member 14 contacting the opening 4 or corner portion 25 of the pack 8 be planar so that it provides a wide contact area.

Figure 39:
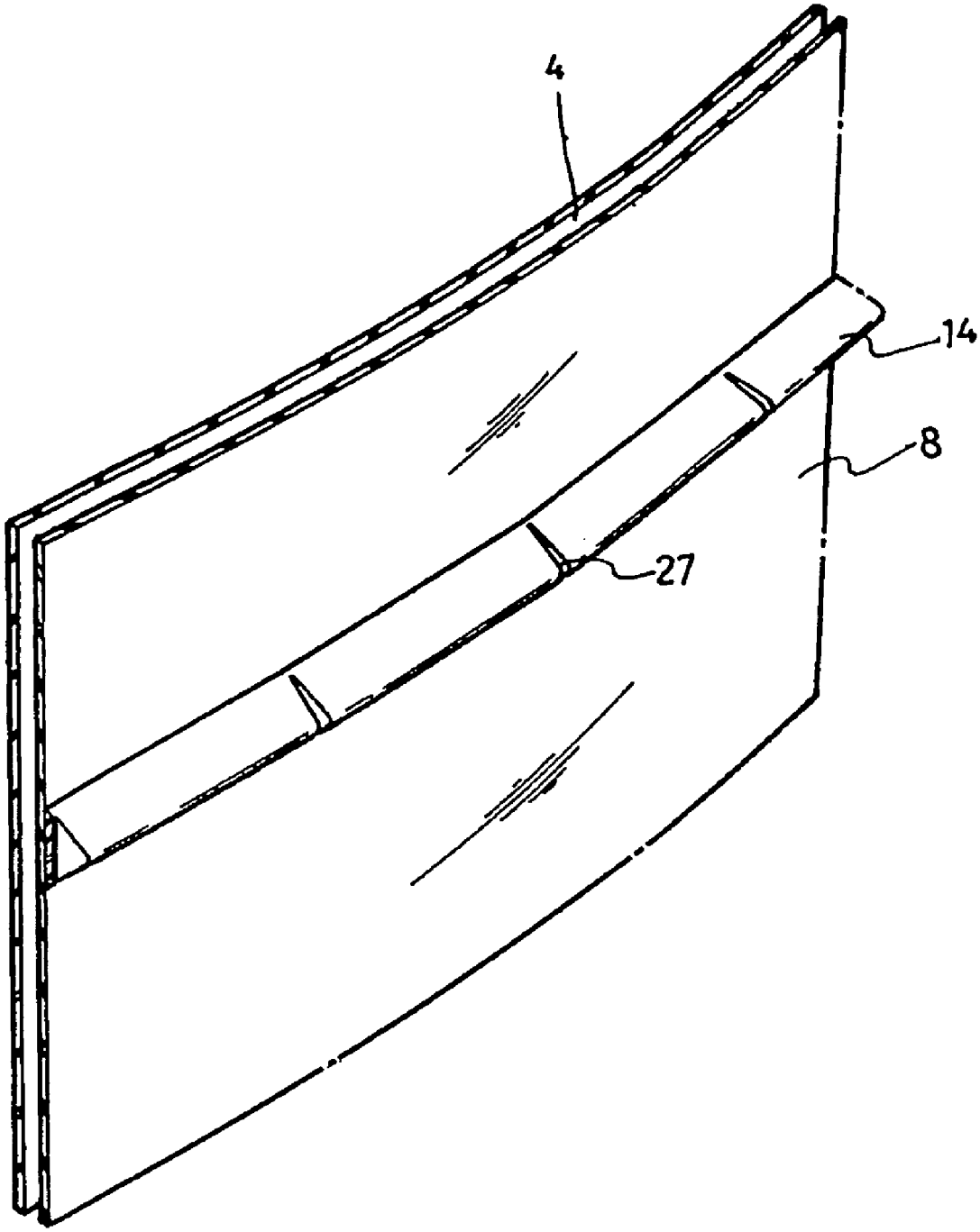
FIG. 39 is an enlarged cross-sectional view corresponding to a part of FIG. 38.
Figure 40:
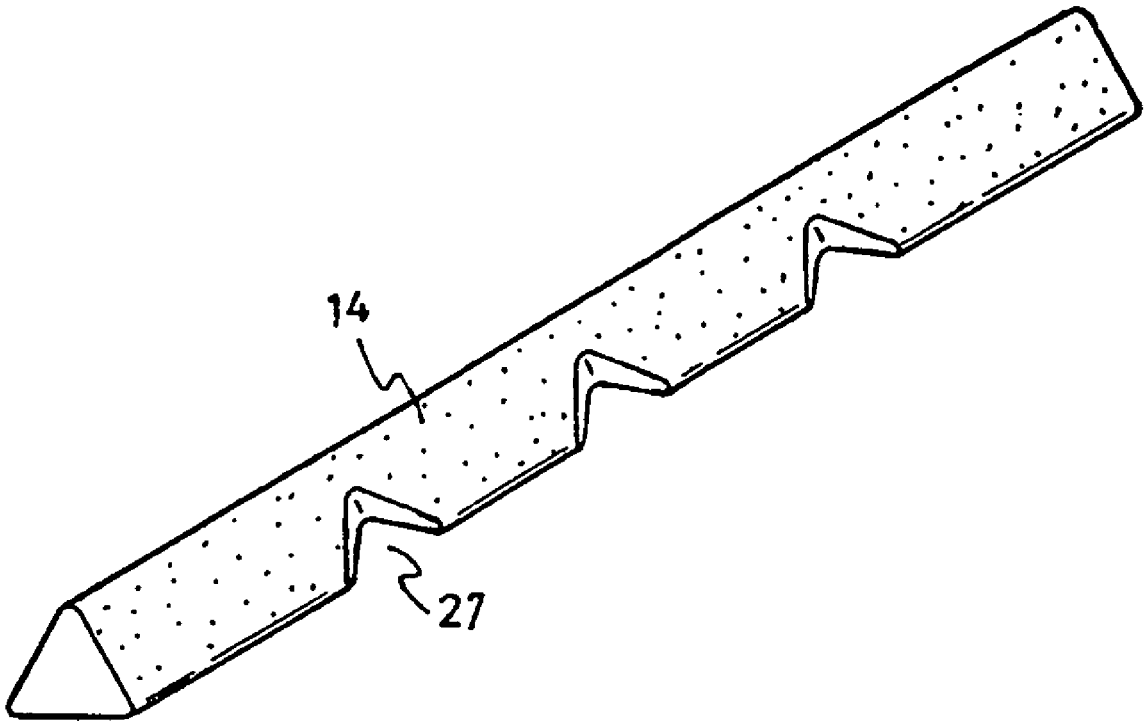
FIG. 40 is an enlarged perspective view illustrating the rod member provided with the grooves.
Figure 41:
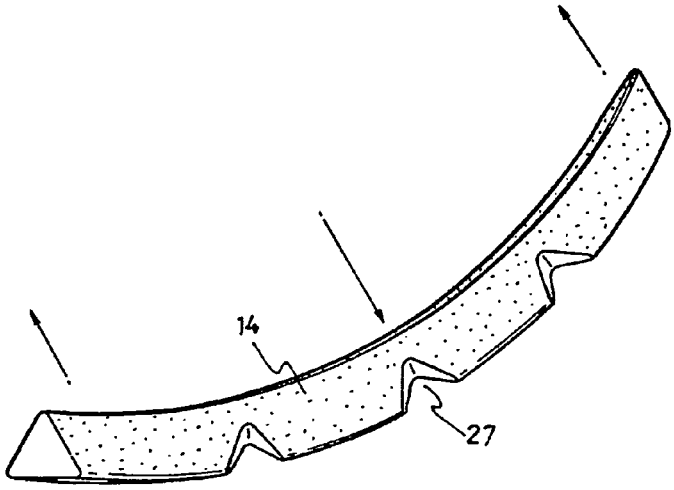
FIG. 41 is a perspective view illustrating the state in which the rod member of FIG. 40 is bent.

Although the rod member 14 and tubular member 16 are preferably made of a flexible or soft material so as to allow the pack 8 to be easily opened, they should be made of a hard material where the pack 8 has a large size or volume.

Where the rod member 14 formed integrally with the opening 4 of the pack 8 or bonded to the opening 4 of the pack 8 is made of a hard material, as in the above described case, it is desirable to form a plurality of uniformly spaced grooves 27 at the rod member 14, as shown in FIGS. 38 to 41, so as to allow the rod member 14 to be easily bent, as shown in FIGS. 39 and 41. In accordance with this structure, the opening 4 of the pack 8 can be easily opened. The space between adjacent ones of the grooves 27 may be appropriately determined in accordance with the size or length of the rod member 14.

Figure 42:
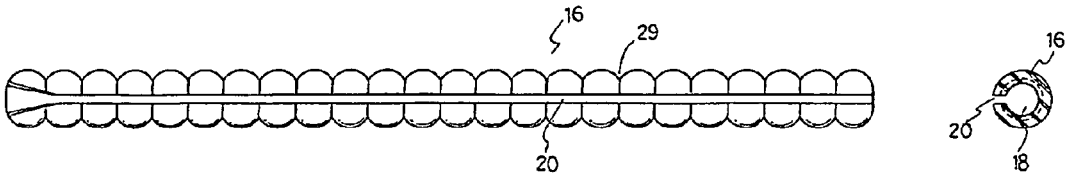
FIG. 42 is a bottom view illustrating a tubular member according to another embodiment of the present invention.

Also, a plurality of annular grooves 29 uniformly spaced from one another by a small distance may be formed at the outer surface of the tubular member 14 in the pack sealing device 2 in accordance with the present invention so that the tubular member 14 has a desired flexibility, as shown in FIG. 42.

Figure 43:
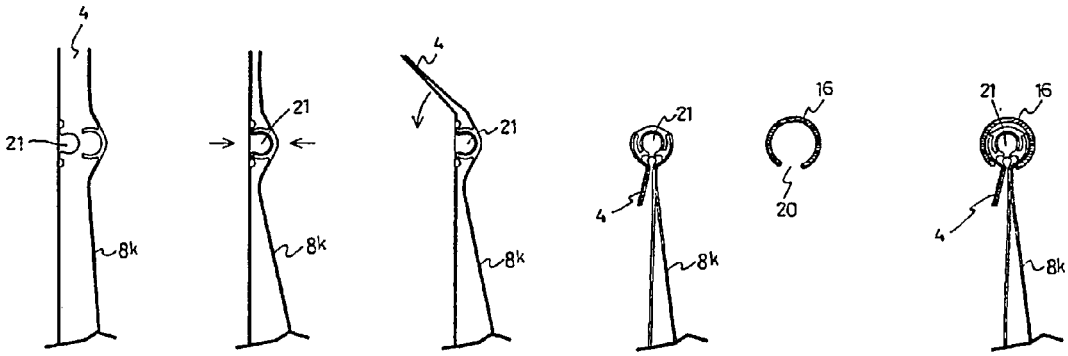
FIG. 43 illustrates a procedure for sealing a zipper pack by the tubular member in accordance with another embodiment of the present invention.

Meanwhile, the pack sealing device 2 may also be applied to a zipper pack 8*k* provided, at the pack opening 4, with a zipper 21 consisting of female and male zipper members, as shown in FIG. 43. In this case, the zipper 21 is wrapped by the opening portion of the zipper pack 8*k* under the condition in which its female and male zipper members are coupled. Thereafter, the tubular member 16 is slidably fitted around the zipper 21 wrapped by the opening portion of the zipper pack 8*k*, so as to seal the zipper pack 8*k*.

Figure 44:
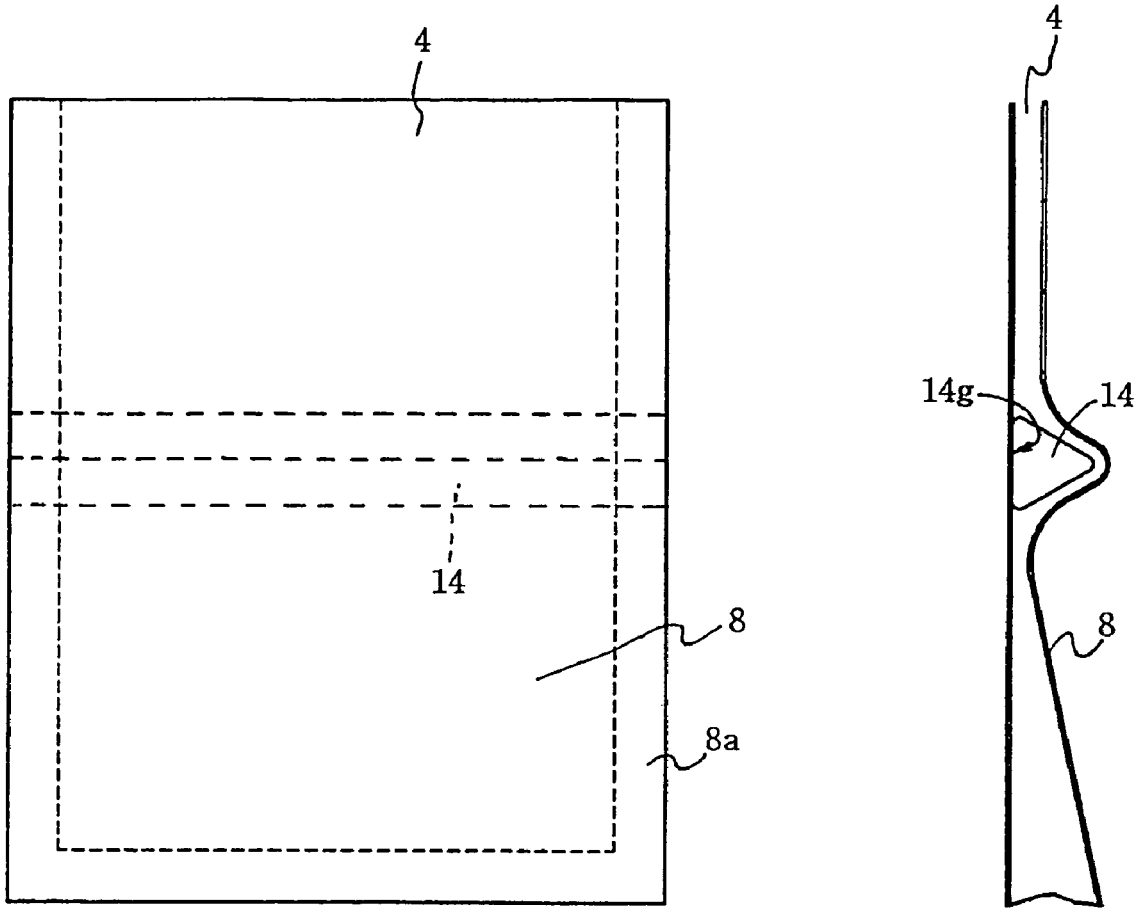
FIG. 44 illustrate, in the form of front and cross-sectional views, the case in which the rod member is installed in the interior of the pack in accordance with another embodiment of the present invention.
Figure 45:
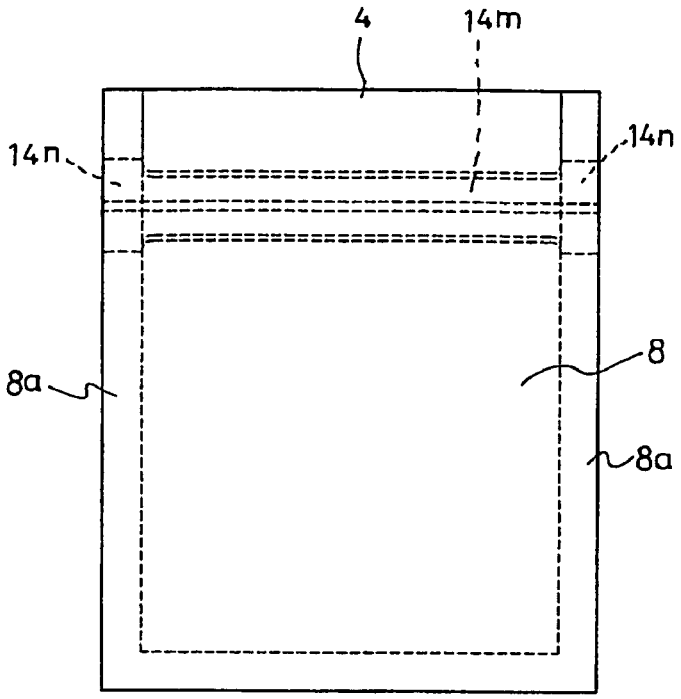
FIG. 45 is a front view illustrating an embodiment of the present invention modified from that of FIG. 44.
Figure 46:
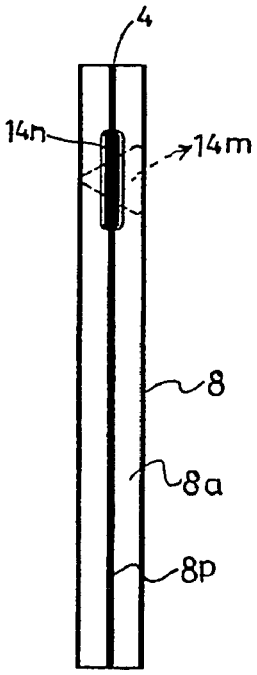
FIG. 46 is a side view corresponding to FIG. 45.
Figure 47:
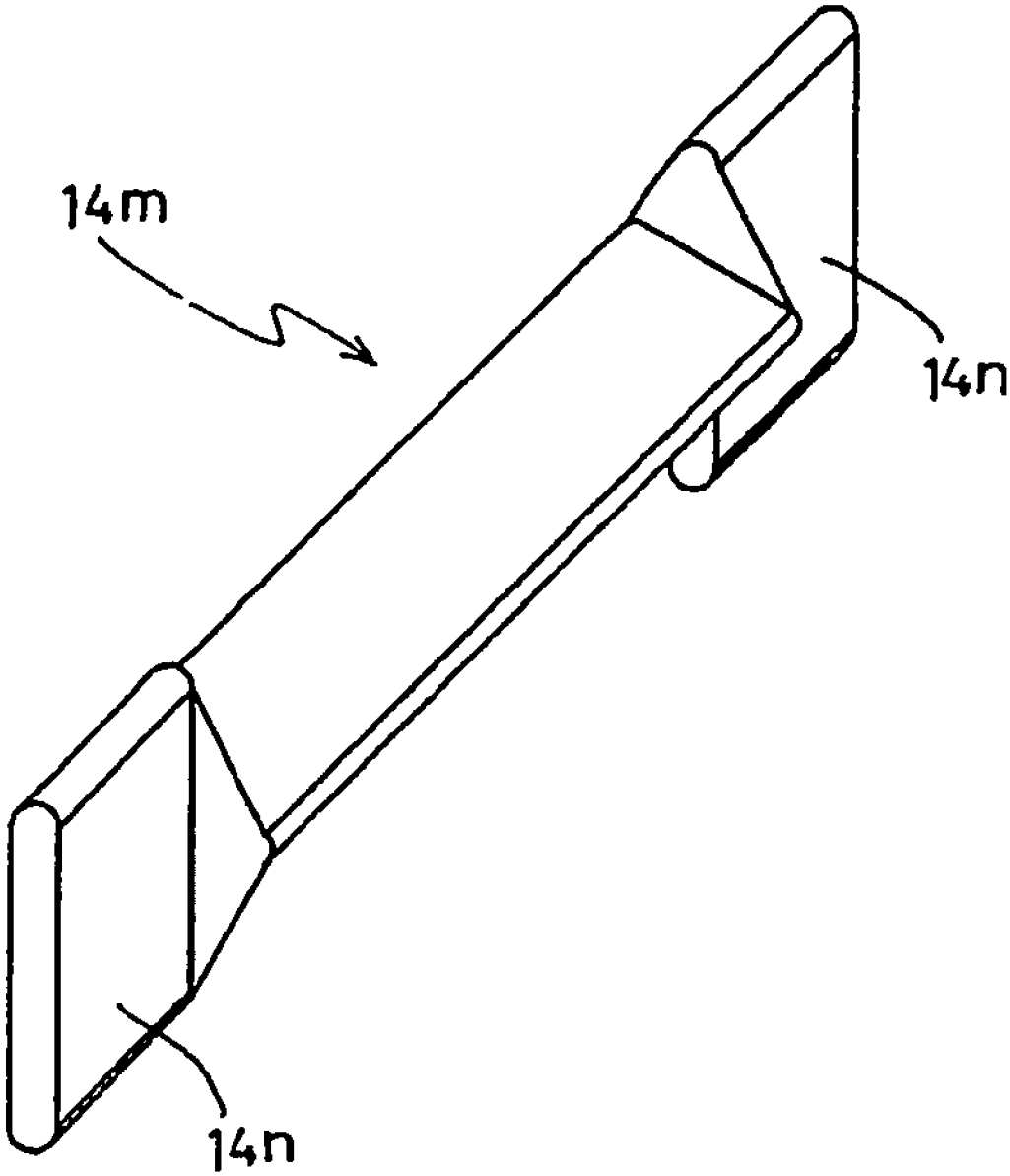
FIG. 47 is a perspective view illustrating the rod member of FIG. 44.
Figure 48:
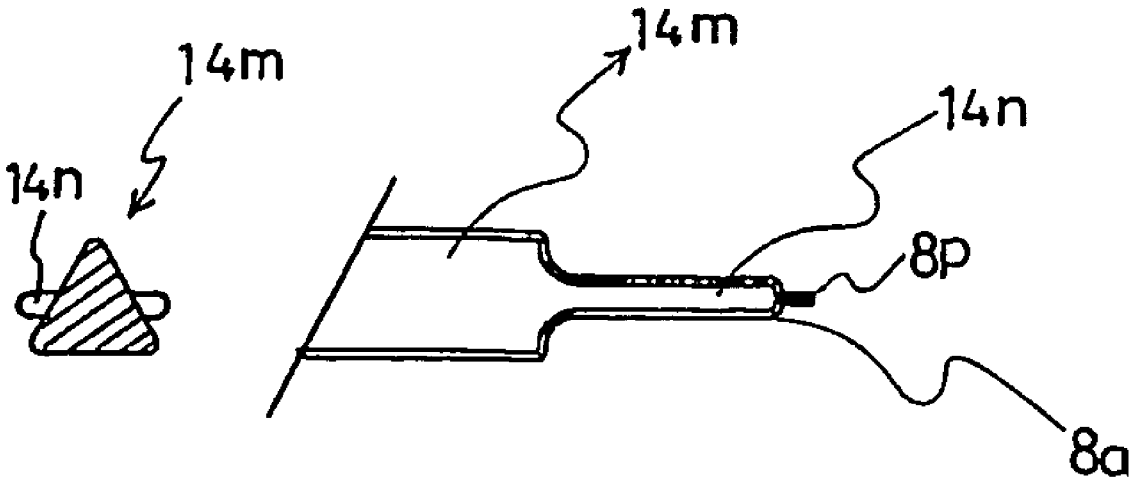
FIG. 48 is a cross-sectional view illustrating the rod member of FIG. 44.

FIG. 44 illustrates, in the form of front and cross-sectional views, another embodiment of the present invention in which the rod member 14 is fixed to the inner surface of the pack 8. In this case, the pack 8 is wrapped around the rod member 14, and the tubular member 16 is then slidably fitted around the rod member 14 wrapped by the pack 8, so as to seal the pack 8.

For example, where the rod member 14 has a triangular cross-sectional shape, it is bonded at both ends thereof to respective opposite lateral seams 8*a* of the pack 8 while being bonded at one flat portion 14*g* thereof to the inner surface of the pack 8, upon manufacturing the pack 8. In this case, it is important to prevent the seal of the pack 8 from being destroyed by the rod member 14.

In the case of FIG. 44, the seams 8*a* of the pack 8 may be excessively protruded due to the cross-sectional shape of the rod member 14. Furthermore, the seal at the seams 8*a* may be destroyed when the rod member 14 is unstably bonded to the seams 8*a*. To this end, the rod member 14 has a triangular cross-sectional shape at a middle portion 14*m* thereof while having flat portions 14*n* of a reduced thickness at both ends thereof to be bonded to respective lateral seams 8*a* of the pack 8, respectively.

Since the rod member 14 has the flat portions 14*n* having a reduced thickness, it can be firmly bonded to the seams 8*a* of the pack 8. Preferably, each flat portion 14*n* is centrally aligned with the rod member 14.

Figure 49:
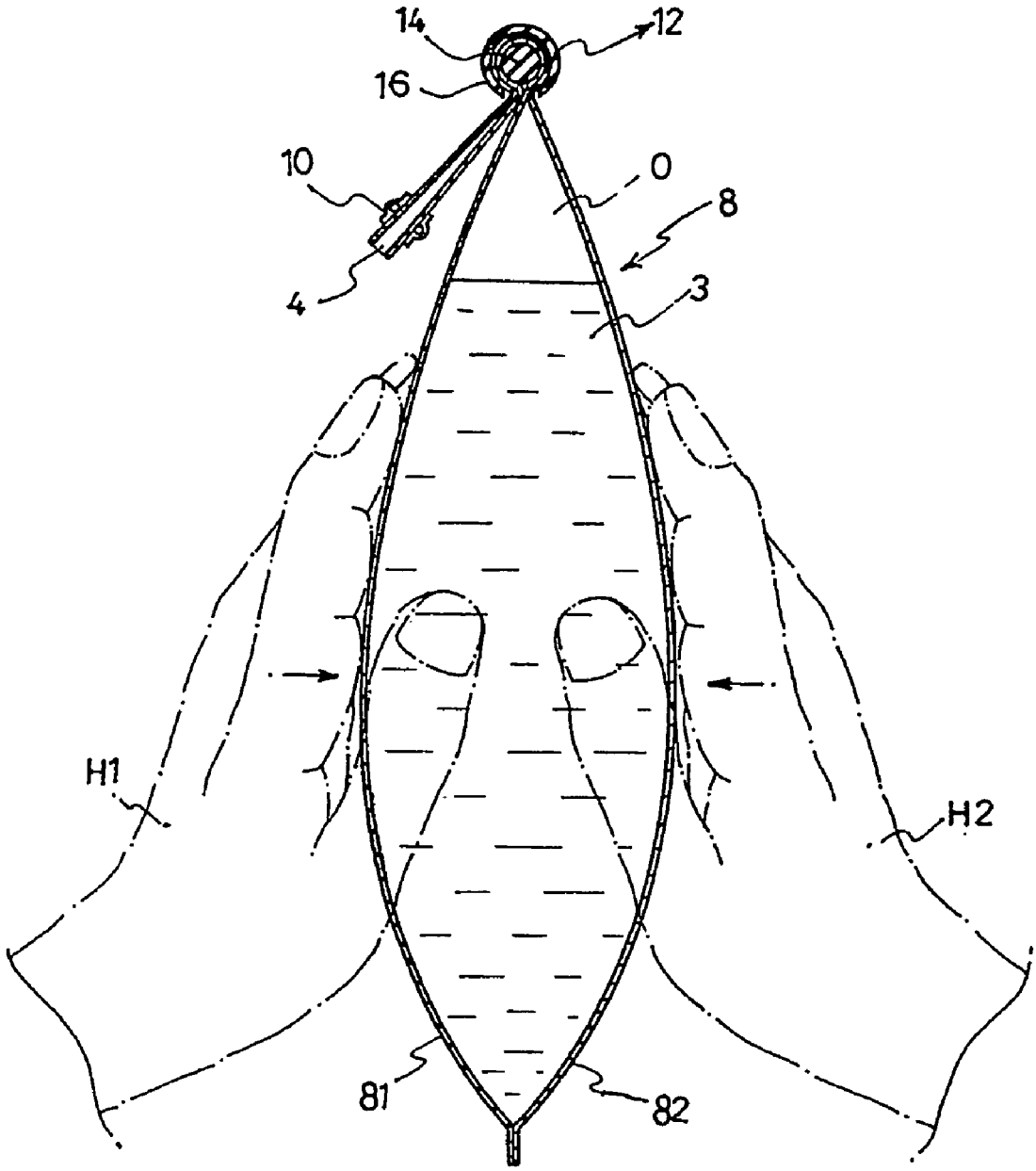
FIG. 49 is a cross-sectional view illustrating a procedure for venting air from the pack in accordance with the present invention.
Figure 50:
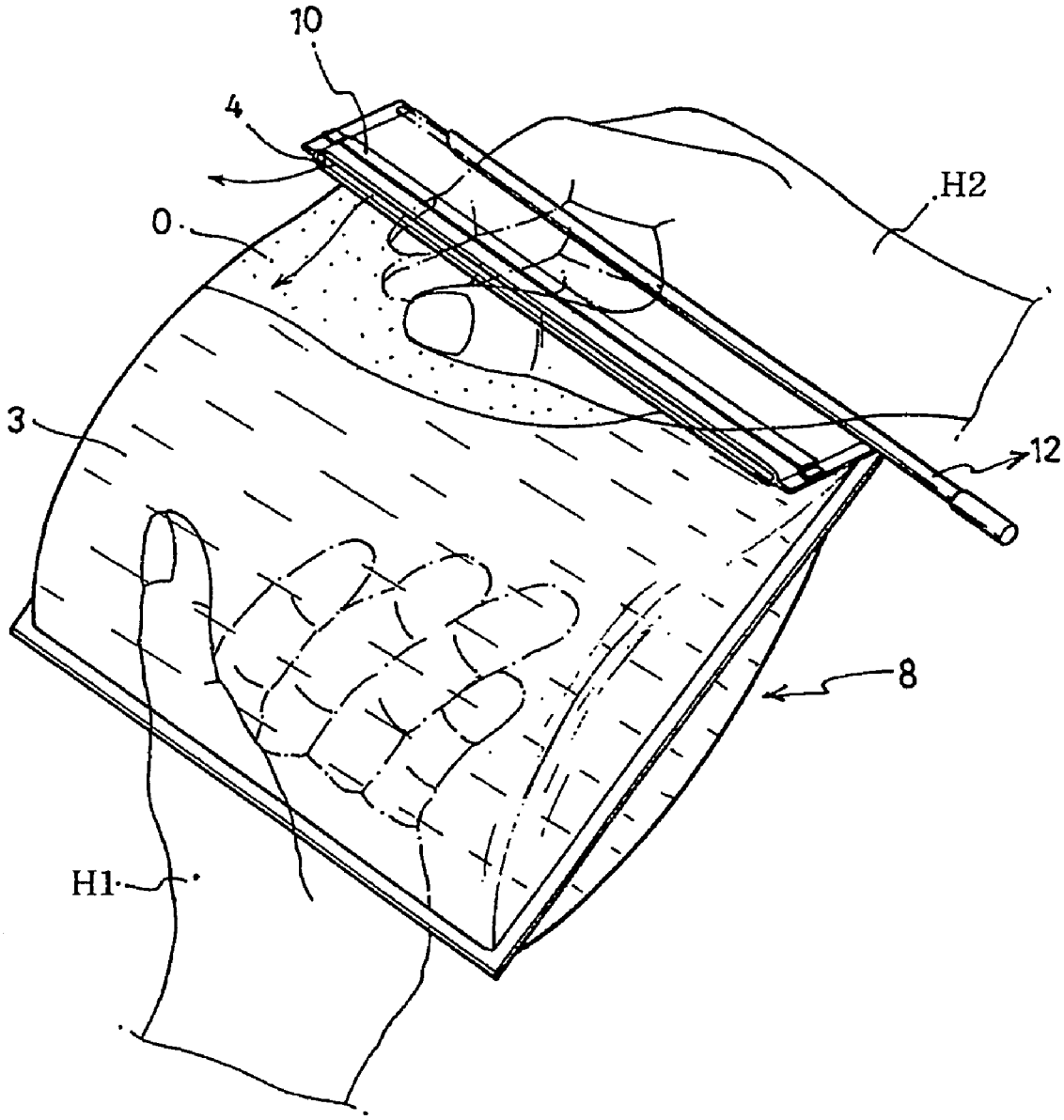
FIG. 50 is a perspective view illustrating the procedure for venting air from the pack in accordance with the present invention.
Figure 51:
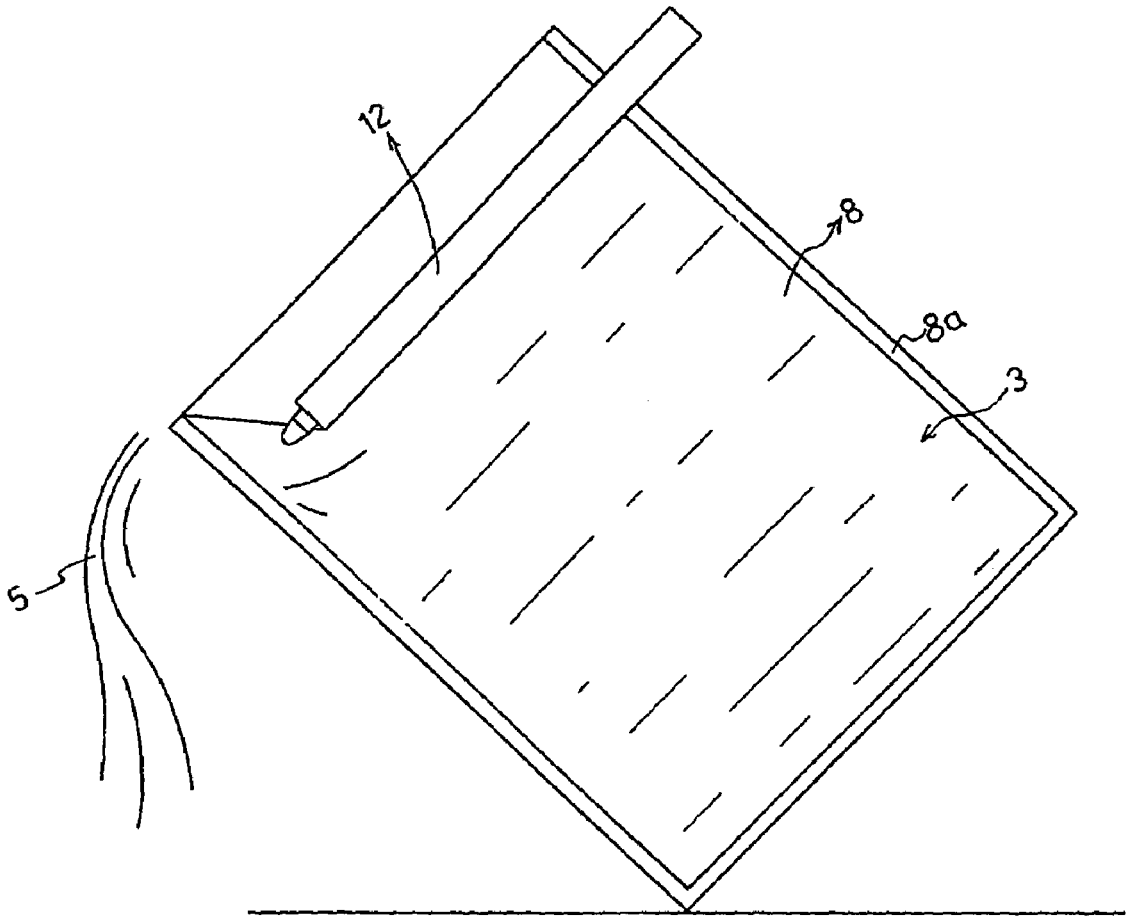
FIG. 51 is a front view illustrating a procedure for taking out the contents of the pack in accordance with the present invention.

FIGS. 49 and 50 illustrate an example of a procedure for sealing the pack 8 after putting contents, such as a food 3, into the pack 8.

When it is desired to put a food 3 of a liquid phase containing liquid ingredients, such as soup, into the pack 8, the user widens the opening 4 by the hands to open the opening 4. At this time, the opening 4 is retained in a widened state by the shape retaining means 10.

In this state, the user puts a desired amount of the food 3 into the pack 8 through the widened opening 4, wraps the rod member 14 by the opening portion of the pack 8 including the opening 4, and then slidably fits the tubular member 16 around the rod member 14 by pushing the tubular member 16 along the rod member 14. Thus, the pack sealing device 12 is coupled to the pack 8. Prior to such a coupling of the pack sealing device 12, the opening 4 of the pack 8 is temporarily maintained in an incompletely sealed state by incompletely pushing the tubular member 16 along the rod member 14, as shown in FIG. 50, in order to vent air from the pack 8. In this state, the user depresses the pack 8 at opposite sides while holding the front and rear vinyl films 81 and 82 of the pack by the hands H1 and H2, as shown in FIG. 49. As the pack 8 is depressed, it is contracted, thereby causing the food 3 to rise in the pack 8. As a result, air O present above the food 3 is vent from the pack 8.

After completely vent the air O present in the pack 8 by continuously depresses the pack 8 by the hands H1 and H2, the user completely pushes the tubular member 16 along the rod member 14, so as to completely fit the tubular member 16 around the rod member 14. Thus, the pack 8 is completely sealed.

Where it is difficult to completely vent the air O, the user pushes the tubular member 16 along the rod member 14 under the condition in which he depresses the pack 8 by the hands H1 and H2 until a small amount of the food 3 is slightly leaked from the pack 8. Accordingly, it is possible to completely seal the pack 8 in a state in which the air O has been completely vented.

Since the interior of the pack 8 is maintained in a vacuum state in accordance with a completely ventilation of air therefrom, it is possible to prevent the food 3 from being oxidized and rotting, while maintaining the freshness and intrinsic smell of the food. Accordingly, the food 3 can be stored for a prolonged period of time.

Generally, a considerable amount of gas (oxygen, etc.) is present, in a dissolved state, in water such as city water. In the case of a food cooked using such water, gas contained in the food is escaped from the water during a procedure of cooling the food because it is evaporated. Accordingly, where such a cooked food is packed in a pack, it can have a state approximate to a vacuum state when air visible to the naked eye is removed from the pack.

Since the pack 8 of the present invention can prevent gas or smell molecules of the food 3 from escaping therefrom by virtue of its vinyl film having a dense structure, it is possible to maintain the freshness and intrinsic smell and taste of the food 3 for a prolonged period of time. Also, the pack 8 is hygienic because its inner film contacting the food 3 is made of a polyethylene (PE) film or polypropylene (PP) film.

For example, even when a highly smelly food, such as fish, beef, or Kimchi, is packed in the pack 8 in a sealed state, and then it is stored in a refrigerator, there is no occasion that the smell of the fish, beef, or Kimchi permeates the refrigerator, because the smell molecules of the fish, beef, or Kimchi cannot escape from the pack 8.

In the case in which such a food is stored in a frozen state in a pack made of a general vinyl, for several months, however, the smell of the refrigerator may permeate the food. In accordance with the present invention, it is also possible to prevent the freshness and intrinsic smell and taste of the fish, beef, or Kimchi from being degraded, because the smell of the refrigerator cannot permeate the pack 8.

Meanwhile, the pack 8 and pack sealing device 12 of the present invention can be reused after being washed. Accordingly, there is an advantage in terms of use of resources.

Also, the present invention is applicable to temporary storage of garbage rotting easily and severely while smelling highly. That is, such garbage may be accumulatively put into the pack of the present invention to be temporarily stored prior to disposal thereof.

In particular, it is wasteful to dump the pack 8 once used to store Kimchi or other food. In this regard, where such a pack is reused to store food garbage or other garbage in a sealed state, there is an advantage in that it is unnecessary to daily dump such garbage because the smell of the garbage can be perfectly confined in the pack in accordance with the present invention. Even in the summer season in which garbage may rot easily and severely, there is no problem caused by such rotting of garbage.

Also, where the pack and pack sealing device of the present invention are used to store food of a liquid phase such as sweet drink made from fermented rice, beef soup, anchovy soup, loach soup, or soup of chopped beef with various condiments, or side dishes, such food or side dishes may be cooked in a large amount, and stored in the freezing or refrigerating compartment of a refrigerator in a state of being packed in the pack 8 so that they may be subsequently taken out from the pack 8 in a desired amount.

The food may be packed in dosage in a plurality of packs, respectively. In this case, the packs may be stored in a frozen state in the freezing compartment of the refrigerator so that the food can be taken in dosage after being thawed every time it is to be taken.

A desired number of the frozen packs stored in the freezing compartment of the refrigerator may be periodically transferred to the refrigerating compartment of the refrigerator so that they are stored in a refrigerated state. In this case, it is possible to eliminate the time taken to thaw the frozen food before the user takes the food.

Also, the pack and pack sealing device of the present invention may be used to store boiled rice. For example, boiled rice may be put in a rice bowl which is, in turn, packed in the pack 8 of the present invention. In this case, the taste of the boiled rice can be maintained for a prolonged period of time. Where food is stored in the pack 8 of the present invention in a state of being put in a port, it is possible to maintain the freshness and intrinsic smell and taste of the food for a prolonged period of time because the smell of the food is perfectly confined in the pack 8, and external smell cannot permeate the pack 8.

In addition, the pack and pack sealing device of the present invention may be used to store food to be taken in a picnic party or other events for leisure. Cooked food or food prepared to be simply cooked may be packed in the pack 8 in a sealed state, and then transported to an event place. In this case, there is convenience in that it is unnecessary to perform a complicated cooking process in the event place.

It is also possible to prevent the smell of the food 3 from permeating the vehicle transporting the food 3 because the pack 8 prevents diffusion of the food smell. Thus, it is possible to prevent the interior of the vehicle from being contaminated. Where the food packed in the pack is soup or pot-stew, there is convenience in that the user can take the food after simply heating or boiling the food in the event place without requiring any cooking process.

Since the pack sealing device 12 of the present invention provides a strong seal effect, it is possible to prevent gas from being introduced into the pack or outwardly leaked from the pack. Also, the pack 8 can sufficiently withstand an excessive expansion pressure generated therein because it is made of a vinyl film having a high toughness. That is, the pack 8 exhibits a superior seal effect for fermentable food. After an experiment, it could be seen that there is no occasion that gas generated in accordance with a fermentation of the food stored in the pack is leaked through the front and rear vinyl films 81 and 82 of the pack 8 or through the pack sealing device 12, or causes the pack 8 to be exploded.

Since the vinyl film of the pack 8 has a surface having a certain smoothness, and the elements of the packing sealing device 12 are machined to have a certain smoothness, it is possible to easily achieve the coupling of the pack sealing device 12 to the pack 8.

When the user widens the opening 4 of the pack 8 to put the food 3 into the pack 8, the shape retaining means 10 retains the opening 4 in the widened state. Accordingly, the user can easily put the food 3 into the pack 8. It is also possible to prevent the food 3 from being smeared on the outer surface of the pack 8 around the opening 4 or flowing along the outer surface of the pack 8 during the process of putting the food 3 into the pack 8. Thus, the pack 8 can be maintained in a clean state.

Also, it is possible to reduce the phenomenon that the pack 8 is folded or otherwise varied in shape at its middle portion during the process of putting the food 3 into the pack 8, as compared to conventional cases. Accordingly, there are advantages in that it is possible to conveniently use the pack 8 while reducing the time taken to put the food 3 into the pack 8.

When it is desired to take out the food 3 packed in a vacuum state in the pack 8, the user first laterally pulls the pack sealing device 12 such that the opening 4 of the pack 8 is slightly opened, and then inclines the pack 8 to take out a desired amount of the food 3 through the opened opening 4, as shown in FIG. 50. Thereafter, the user depresses the pack 8 at opposite sides while holding the front and rear vinyl films 81 and 82 of the pack 8 by the hands, as described above, in order to substantially completely vent air O present in the pack 8. Finally, the user laterally pushes the pack sealing device 12 to seal the opening 4 of the pack 8. Thus, the remaining food 3 can again be packed in a vacuum state in the pack 8.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

In accordance with the present invention, it is possible to pack diverse liquid, gaseous, and solid materials or objects in a sealed or vacuum state after putting such a material or object into the pack of the present invention through the opening of the pack, and then sealing the opening of the pack by the pack sealing-device of the present invention. The pack and pack sealing device of the present invention can be simply and conveniently used by young and old, men and women. Since each of the pack and pack sealing device of the present invention has a simple structure, it can provide a reliable sealing or vacuum effect without any failure.

When it is desired to store food in a sealed or vacuum state, this storage can be simply and conveniently achieved using the pack and pack sealing device of the present invention. When the food packed in the pack is to be taken out for its cooking or consumption by the user, the sealed or vacuum state of the pack can be simply released as the user laterally pulls or pushes the pack sealing devices. In such a manner, the food packed in the pack can be repeatedly taken out and stored in a vacuum or sealed state.

Since each of the pack and pack sealing device of the present invention has a simple structure, it can be easily used by people, young and old, men and women all alike, without involving any failure thereof. In some applications, the pack and pack sealing device of the present invention make our daily life more convenient. Thus, the present invention is useful in the pursuit of a happy daily life.

The invention claimed is:

1. A pack sealing device including a rod member, a tubular member adapted to be slidably fitted around the rod member, a squeeze gap defined between the rod member and the tubular member, a slit formed at the tubular member to extend in a longitudinal direction of the tubular member, an inclined guide formed at one end of the rod member, and another inclined guide formed at one end of the tubular member, wherein:

the tubular member has a circular cross-sectional shape; and the rod member is formed, at one end thereof, with a bent portion extending inclinedly toward the slit of the tubular member in a state, in which the rod member is fitted in the tubular member, a horizontal extension formed to extend horizontally from an end of the bent portion opposite to the rod member, and a semicircular protrusion formed at an end of the horizontal extension opposite to the bent portion.

2. The pack sealing device according to claim 1, wherein the pack sealing device further includes at least one ring provided at an outer surface of the tubular member.

3. The pack sealing device according to claim 1 or 2, wherein the rod member is formed, at one end thereof, with a protruded stopper having a vertical surface and an inclined surface.

4. The pack sealing device according to claim 1 or 2, wherein the rod member is made of a hard material, and provided, at an outer surface thereof, with a plurality of grooves uniformly spaced apart from one another by a small distance and adapted to allow the rod member to be flexible.

5. The pack sealing device according to claims 1 or 2, wherein:

the rod member is fixedly bonded to an outer surface of a pack to be sealed; and the tubular member is separably coupled to the rod member.

6. The pack sealing device according to claims 1 or 2 wherein:

the rod member is fixedly bonded to an inner surface of a pack to be sealed; and the tubular member is separably coupled to the rod member.

7. sealing device according to claim 1 or 2, wherein the rod member has a cross-sectional shape selected from a group consisting of circular semicircular, oval, rectangular, diamond, trapezoidal, and polygonal cross-sectional shapes.

8. pack sealing device according to claim 1 or 2, wherein:

the rod member is fixedly bonded to an inner surface of a pack to be sealed;

the tubular member is separably coupled to the rod member; and the rod member has flat portions of a reduced thickness at both ends thereof, respectively.

9. The pack sealing device according to claim 1 or 2, wherein:

the rod member is fixedly bonded to an outer surface of a pack, to be sealed, near one corner portion of the pack such that it extends inclinedly; and the tubular member is separably coupled to the rod member.

10. A method for sealing a zipper pack provided at an opening thereof with a zipper including male and female zipper members, comprising the steps of:

coupling the male and female zipper members of the zipper;

wrapping a portion of the zipper pack around the zipper; and slidably fitting a slit tubular member around the zipper wrapped by the pack portion such that the pack extends through a slit formed at the tubular member, thereby sealing the zipper pack.

* * * * *